US012655363B2

(12) United States Patent
Pirrung et al.

(10) Patent No.: US 12,655,363 B2
(45) Date of Patent: Jun. 16, 2026

(54) AQUEOUS DISPERSIONS OF PARAFFIN INHIBITORS

(71) Applicant: BASF SE, Ludwigshafen am Rhein (DE)

(72) Inventors: Frank Pirrung, Ludwigshafen am Rhein (DE); Rainer Packe-Wirth, Trostberg (DE); Oscar Lafuente Cerda, Trostberg (DE); Serge Ikink, Arnhem (NL); Jan Donath, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 18/685,678

(22) PCT Filed: Aug. 17, 2022

(86) PCT No.: PCT/EP2022/072982
§ 371 (c)(1),
(2) Date: Feb. 22, 2024

(87) PCT Pub. No.: WO2023/025636
PCT Pub. Date: Mar. 2, 2023

(65) Prior Publication Data

US 2024/0352371 A1 Oct. 24, 2024

(30) Foreign Application Priority Data

Aug. 27, 2021 (WO) ..... PCT/EP2021/073751

(51) Int. Cl.

| | |
|---|---|
| ***C10L 10/16*** | (2006.01) |
| ***C10L 1/12*** | (2006.01) |
| ***C10L 1/16*** | (2006.01) |
| ***C10L 1/182*** | (2006.01) |
| ***C10L 1/185*** | (2006.01) |
| ***C10L 1/196*** | (2006.01) |
| ***C10L 1/197*** | (2006.01) |
| ***C10L 1/198*** | (2006.01) |
| ***C10L 1/24*** | (2006.01) |
| ***C10L 1/26*** | (2006.01) |
| ***C10L 10/14*** | (2006.01) |

(52) U.S. Cl.
CPC ..... *C10L 10/16* (2013.01); *C10L 1/125* (2013.01); *C10L 1/1616* (2013.01); *C10L 1/1641* (2013.01); *C10L 1/1826* (2013.01); *C10L 1/1852* (2013.01); *C10L 1/1963* (2013.01); *C10L 1/1966* (2013.01); *C10L 1/1973* (2013.01); *C10L 1/1983* (2013.01); *C10L 1/2431* (2013.01); *C10L 1/2437* (2013.01); *C10L 1/2608* (2013.01); *C10L 1/2641* (2013.01); *C10L 10/14* (2013.01); *C10L 2250/06* (2013.01); *C10L 2250/082* (2013.01); *C10L 2300/40* (2013.01)

(58) Field of Classification Search
CPC ..... C10L 10/16; C10L 1/125; C10L 1/1616; C10L 1/1641; C10L 1/1826; C10L 1/1852; C10L 1/1963; C10L 1/1966; C10L 1/1973; C10L 1/1983; C10L 1/2431; C10L 1/2437; C10L 1/2608; C10L 1/2641; C10L 10/14; C10L 2250/06; C10L 2250/082; C10L 2300/40; C10L 1/1233; C10L 1/10; C09K 2208/32; C09K 23/04; C09K 8/524
See application file for complete search history.

(56) References Cited

U.S. PATENT DOCUMENTS

| | | | | |
|---|---|---|---|---|
| 5,108,654 | A | 4/1992 | Ragaini | |
| 5,851,429 | A | 12/1998 | Magyar | |
| 2017/0292657 | A1 | 10/2017 | Kundu | |
| 2019/0276756 | A1 | 9/2019 | Chichak et al. | |
| 2020/0291319 | A1 † | 9/2020 | Pirrung | |
| 2020/0308471 | A1 * | 10/2020 | Bohres | C09K 8/86 |

FOREIGN PATENT DOCUMENTS

| | | | |
|---|---|---|---|
| DE | 2612757 | A1 | 9/1977 |
| EP | 0214786 | A1 | 3/1987 |
| EP | 1557411 | A1 | 7/2005 |
| EP | 1746147 | A1 | 1/2007 |
| GB | 1468588 | A | 3/1977 |
| GB | 2308129 | A | 6/1997 |
| WO | 98/51731 | A1 | 11/1998 |
| WO | 99/29748 | A1 | 6/1999 |
| WO | 2004/035715 | A1 | 4/2004 |
| WO | 2006/075109 | A1 | 7/2006 |
| WO | 2007/147753 | A2 | 12/2007 |

(Continued)

OTHER PUBLICATIONS

International Search Report and Written Opinion received for PCT Patent Application No. PCT/EP2022/072982, mailed on Nov. 28, 2022, 8 pages.

(Continued)

*Primary Examiner* — Cephia D Toomer

(74) *Attorney, Agent, or Firm* — Faegre Drinker Biddle & Reath LLP

(57) ABSTRACT

Aqueous dispersion of paraffine inhibitors, comprising a continuous aqueous phase comprising water and a water-miscible organic solvent, a dispersed phase comprising at least one paraffin inhibitor component, and at least one anionic surfactant, methods of manufacturing such aqueous dispersions, and the use of such aqueous dispersions as paraffin inhibitor or pour point depressant for crude oil or other hydrocarbon fluids, such as fuel oils or diesel.

12 Claims, No Drawings

(56) References Cited

FOREIGN PATENT DOCUMENTS

| | | | | |
|---|---|---|---|---|
| WO | 2008/125588 | A1 | 10/2008 | |
| WO | 2014/095408 | A1 | 6/2014 | |
| WO | 2014/095412 | A1 | 6/2014 | |
| WO | 2015/124529 | A1 | 8/2015 | |
| WO | 2017/153462 | A1 | 9/2017 | |
| WO | 2018/104071 | A1 | 6/2018 | |
| WO | 2019/048663 | A1 | 3/2019 | |
| WO | 2019/057396 | A1 | 3/2019 | |
| WO | 2019/089043 | A1 | 5/2019 | |
| WO | WO-2019185401 | A1 * | 10/2019 | ..... C08G 63/48 |

OTHER PUBLICATIONS

International Preliminary Report on Patentability received for PCT Patent Application No. PCT/EP2022/072982, mailed on Mar. 7, 2024, 6 pages.

International Search Report for PCT Patent Application No. PCT/EP2021/073751, Issued on Jun. 15, 2022, 3 pages.

* cited by examiner
† cited by third party

AQUEOUS DISPERSIONS OF PARAFFIN INHIBITORS

This application is a National stage application (under 35 U.S.C. § 371) of PCT/EP2022/072982, filed Aug. 17, 2022, which claims benefit of European Application No. PCT/EP2021/073751, filed Aug. 27, 2021.

The invention relates to an aqueous dispersion of paraffine inhibitors, comprising a continuous aqueous phase comprising water and a water-miscible organic solvent, a dispersed phase comprising at least one paraffin inhibitor component, and at least one anionic surfactant. The invention furthermore relates to methods of manufacturing such aqueous dispersions, and the use of such aqueous dispersions as paraffin inhibitors or pour point depressants for crude oil or other hydrocarbon fluids, such as fuel oils or diesel.

The deposit temperature of oil deposits is generally above the ambient temperature at ground level. Accordingly, produced crude oils are generally at elevated temperature and, after being produced, naturally cool down more or less quickly to the ambient temperature.

According to their origin, crude oils comprise different proportions of what are called waxes, which consist essentially of long-chain n-paraffins. According to the type of crude oil, the proportion of such paraffins may typically be 1% to 30% by weight of the crude oil. The paraffins can crystallize and precipitate out in the form of platelets in the course of cooling of the crude oil after production. The lowest temperature at which a sample of an oil still just flows in the course of cooling is referred to as the pour point. For the measurement of the pour point, standardized test methods are used. Wax-rich types of mineral oil can have a pour point up to about 50° C.

Crystallized paraffins considerably impair the flowability of the oil. Precipitated paraffins can block filters, pumps, pipelines and other installations or be deposited in tanks, thus entailing a high level of cleaning.

It is known that the pour point of crude oils can be lowered by suitable additives. This can prevent paraffins from precipitating and being able to form deposits in the course of cooling of produced crude oil. Additives of this kind are referred to, for example, as pour point depressants, paraffin inhibitors, wax inhibitors or flow improvers. These are generally polymers.

Examples of polymers for use as paraffin inhibitors or pour point depressants include copolymers of ethylene, vinyl esters and alkyl (meth)acrylates or graft copolymers obtainable by polymerization of alkyl (meth)acrylates in the presence of ethylene-vinyl ester copolymers, as described, for example, by WO 2014/095412 A1, WO 2014/095408 A1 or WO 2015/124529 A1. Further examples include copolymers of long-chain olefins and maleic anhydride, where the copolymerized maleic anhydride units are reacted in a second step with long-chain alcohols, for example behenyl alcohol, as disclosed, for example, by GB 1 468 588, EP 214 786 A1 and EP 1 746 147 A1.

Additives of this kind for use as paraffin inhibitors or pour point depressants are frequently wax-like, solid products. They therefore have to be melted or dissolved and suitably formulated for use. This means additional apparatus and/or personnel demands for the user, who would like to avoid these. This is especially important when there is a shortage of space, as, for example, on a mineral oil platform. Users are therefore frequently demanding ready-to-use formulations.

Ready-to-use formulations may, for example, be solutions of pour point depressants in organic solvents, especially hydrocarbons.

Ready-to-use formulations may also be aqueous compositions in which solid particles of paraffin inhibitors are distributed in aqueous compositions. Such compositions of pour point depressants or paraffin inhibitors are known, for example from DE 26 12 757 A1, WO 98/51731 A1 or WO 2008/125588 A1. Aqueous compositions are very popular with users because working with organic solvents is avoided and higher actives at lower viscosity can be dosed.

A number of demands are placed on aqueous compositions of pour point depressants. They should firstly have a maximum content of pour point depressant in order to save transport costs and storage costs. This is especially important when there is a shortage of storage space, as, for example, on a mineral oil platform. But the higher the concentration, the more quickly the aqueous compositions will solidify. In addition, the compositions are to be stable in spite of a relatively high concentration. Finally, suitable compositions must also still be free-flowing at temperatures below the freezing point. This is important when they are to be used in a cold environment, for example in Arctic regions.

WO 2006/075109 A1 discloses aqueous emulsions comprising 5 to 70% by weight of a copolymer comprising $C_6$-$C_{60}$ (meth)acrylates, 0.05% to 30% by weight of a cosolvent miscible with water and 0.1 to 10% by weight of surfactants.

WO 2008/125588 A1 discloses a process for preparing a paraffin inhibitor formulation, comprising the steps of preparing a mixture comprising a waxy paraffin inhibitor having a melting point of >0° C., water and an emulsifier at a temperature above the melting point of the waxy paraffin inhibitor, thereby forming an oil-in-water emulsion, and cooling the oil-in-water emulsion to a temperature below the melting point of the waxy paraffin inhibitor. The paraffin inhibitor may be an alcohol modified olefine-maleic acid anhydride copolymer. The amount of emulsifier is from 1 to 30% by weight relating to the emulsion and the emulsifier may be selected from a wide variety of anionic, cationic, non-ionic or amphoteric emulsifiers. The example teaches that 49% of the particles obtained have a particle size<1 μm and 100% of the particles are <5 μm, i.e. about 50% of the particles are larger than 1 μm.

WO 2019/057396 A1 discloses an aqueous dispersion comprising an organic phase comprising cold flow improvers for mineral oils comprising 0.5% to 12% by weight of a dispersing agent comprising 5% to 95% by weight of an ether carboxylic acid and 95% to 5% by weight of an non-ionic surfactant. The cold flow improvers may be copolymers of ethylene and ethylenically unsaturated esters, ethers or alkenes, homo- or copolymers of esters, Amides and/or imides of ethylenically unsaturated carboxylic acids comprising $C_{10}$ to $C_{30}$ alkyl groups.

WO 2019/089043 A1 discloses a method of treating a well or a subterranean formation with an aqueous dispersion comprising 25% to 60% by weight of oil-soluble well treatment agents having a diameter of less than 2 μm and dispersing agents. The well treatment agents may be paraffin inhibitors.

GB 2 308 129 A discloses homogenized liquid dispersions of waxy pour point depressants, wherein the pour point depressants is solid at room temperature, has a number average weight of at least 500 and is a product of the reaction of (a) a hydrocarbyl-substituted phenol and (b) an aldehyde.

The dispersions can be used to supply a pour point depressant to paraffin-containing hydrocarbon materials, such as crude oil.

WO 2017/153462 A1 discloses an aqueous polymer dispersion for use as pour point depressant which is made by mini emulsion polymerization. For making such dispersion, an aqueous monomer emulsion comprising $C_{18/22}$ acrylates and optionally high boiling organic solvents is prepared, treated with a homogenizer or ultrasonic sound, and the mini emulsion thereafter polymerized. For stabilizing the dispersion, a protective colloid, i.e. a polymeric dispersant is used. Non-ionic surfactants may be used in addition.

WO 2019/048663 A1 discloses a similar aqueous polymer dispersion for use as pour point depressant made by mini emulsion polymerization. For stabilizing the dispersion, 0.1% to 20% by weight—relating to the aqueous dispersion—of an ionic surfactant are used. WO 2018/104071 A1 discloses an aqueous dispersion comprising a continuous aqueous phase comprising water and an organic solvent miscible with water having a melting point of less than −20° C., and particles of a paraffin inhibitor component which are dispersed in the aqueous phase. The paraffin inhibitor component comprises an organic solvent which is not miscible with water and a polymeric, oil-soluble paraffin inhibitor comprising olefines and carboxylate groups comprising monomers which are at least partially esterified with alcohols.

The dispersion is stabilized by at least 3 different non-ionic surfactants in an amount of 12% to 35% by weight relating to the paraffin inhibitor component. The examples specifically teach amounts of 13.3% to 15.4% by weight of surfactants relating to the paraffin inhibitor component.

The aqueous dispersions in WO 2018/104071 A1 have a good low-temperature stability, however the amounts of surfactants are high. Also, in other publications cited, the amounts of surfactants—relating to the organic phase, i.e. the paraffin inhibitor component—are high.

Surprisingly, it has been found that aqueous dispersions of paraffin inhibitors having a good low-temperature stability can be obtained by using certain anionic surfactants in relatively low amounts.

Accordingly, an aqueous dispersion has been found, comprising at least (A) a continuous aqueous phase comprising water and a water-miscible organic solvent, (B) a dispersed phase comprising at least one paraffin inhibitor component having a melting point of not more than 100° C., wherein the amount of the paraffin inhibitor component is from 10% to 60% by weight relating to the total of all components of the aqueous dispersion, and the paraffin inhibitor component comprises at least 30% to 100% by weight—relating to the total of the paraffin inhibitor component—of at least one polymeric, oil-soluble paraffin inhibitor (X), 0% to 70% by weight—relating to the total of the paraffin inhibitor component—of a hydrocarbon or a hydrocarbon mixture having a boiling point of at least 100° C., and (C) at least one surfactant (S), wherein the surfactant (S) is anionic and comprises at least one anionic group selected from sulfonate, sulfate, phosphonate or phosphate groups, the amount of the surfactants (S) is from 1% to 7% by weight relating to the paraffin inhibitor component, and the $D_{50}$ particle size (volume size distribution) of the dispersed phase, measured by dynamic light scattering is from 50 nm to 500 nm.

In a second aspect of the present invention, methods of manufacturing such aqueous dispersions have been found.

In a third aspect, the use of the aqueous dispersions as pour point depressant for crude oil and for prevention of wax deposits on surfaces has been found.

In a forth aspect, the use of the aqueous dispersions for reducing the crystallization of paraffin crystals in fuels, for improving the cold flow properties of fuel oils and/or for improving the filterability of fuel oils has been found.

In a fifth aspect, a fuel oil comprising the aqueous dispersion has been found.

With regard to the invention, the following can be stated specifically:

In the aqueous dispersion according to the invention, a dispersed phase comprising at least a paraffin inhibitor component is distributed in a continuous aqueous phase at least comprising water and a water-miscible organic solvent, wherein the dispersion is stabilized by at least one anionic surfactant.

Aqueous Phase

The continuous aqueous phase comprises water and at least one water-miscible organic solvent.

Examples of water-miscible organic solvents especially include alcohols such as methanol, ethanol, n-propanol, i-propanol, ethylene glycol, diethylene glycol, 1,2-propylene glycol, 1,3-propylene glycol, ethylene glycol monomethyl ether, propylene glycol monomethyl ether, dipropylene glycol monomethyl ether, butylene glycol and ethylene glycol monobutyl ether.

In one embodiment of the invention, examples of water-miscible organic solvents include methanol, ethanol, n-propanol, i-propanol, ethylene glycol, diethylene glycol, 1,2-propylene glycol, 1,3-propylene glycol, ethylene glycol monomethyl ether and propylene glycol monomethyl ether.

In another embodiment, examples of water-miscible organic solvents include ethylene glycol, diethylene glycol, 1,2-propylene glycol, 1,3-propylene glycol, ethylene glycol monomethyl ether and propylene glycol monomethyl ether.

The aqueous phase preferably has a melting point of −10° C. or lower, in particular −15° C. or lower, preferably −20° C. or lower, more preferably −25° C. or lower. The melting point may, for example, be in the range from −60° C. to −15° C., especially −50° C. to −20° C.

The respective amounts of water and organic solvent are determined by the person skilled in the art according to the desired melting point of the mixture. Suitable mixing ratios can be taken from relevant tabular works or one can determine them oneself by a few experiments. The amount of water-miscible organic solvents is generally at least 20% by weight, preferably at least 30% by weight, for example 20% by weight to 80% by weight, especially 30% by weight to 70% by weight, based on the total amount of all solvents in the aqueous phase. In certain embodiments of the invention, the amount of the water-miscible organic solvents is from 30% to 50% by weight or from 50% to 80% by weight.

In one embodiment, the amount of water in the aqueous phase (A) is from 20% to 80% by weight, preferably from 30% to 70% by weight, and the amount of water-soluble organic solvents is from 20% to 80% by weight, preferably from 30% to 70% by weight, in each case based on the amount of all components of the aqueous phase.

In one embodiment of the invention, an aqueous phase comprising water and 1,2-propylene glycol and/or ethylene glycol is used, where the proportion of 1,2-propylene glycol and/or ethylene glycol is 40% to 60% by weight, and the remainder of the aqueous phase is water.

Paraffin Inhibitor Component

The dispersed phase of the aqueous dispersion comprises of at least one paraffin inhibitor component. The paraffin inhibitor component comprises at least one polymeric paraffin inhibitor (X). The paraffin inhibitor component may furthermore comprise an organic, water-immiscible solvent. The paraffin component may of course comprise two or more different polymeric paraffin inhibitors (X). In one embodiment of the invention, the paraffin inhibitor component is a mixture of at least one polymeric paraffin inhibitor (X) and an organic, water-immiscible solvent or a mixture of organic, water-immiscible solvent(s).

The term "paraffin inhibitor" in the context of the present invention refers to substances having the property of preventing or at least reducing the separation of paraffins out of hydrocarbon fluids, such as crude oils, mineral oil or mineral oil products such a fuel oil or diesel, and/or the property of reducing the pour point of crude oils, mineral oil or mineral oil products. Paraffin inhibitors are lipophilic by nature and are accordingly water-insoluble or at least barely water-soluble.

Without wishing to be tied to a particular theory, this behavior of paraffin inhibitors can be explained by the fact that paraffins crystallize, typically in the form of platelets, in the course of cooling of crude oil, minerals oils or mineral oil products when the temperature goes below a particular level. The n-paraffin crystals in platelet form can form a kind of house-of-cards structure which encloses the crude oil, such that the crude oil ceases to flow, even though the predominant portion is still fluid. Paraffin inhibitors firstly prevent the formation of these house-of-cards-like structures and thus lower the temperature at which the crude oil solidifies. In addition, paraffin inhibitors can promote the formation of very fine, well-crystallized, non-agglomerating paraffin crystals, such that undisrupted oil transport is ensured. They may also reduce the amount of paraffin which precipitates in a certain time.

Polymeric paraffin inhibitors basically are known in the art. Examples comprise homo- or copolymers of long-chain alkyl esters of ethylenically unsaturated mono- or dicarboxylic acids as well as homo- or copolymers of long-chain alkylvinylethers. Further examples comprise copolymers of ethylene and vinylesters, for example vinylacetate. Also, mixtures of such ethylene-vinylacetate copolymers with long-chain polyacrylates may be used or copolymers, available by polymerization of long-chain acrylates, for example $C_{16}$- to $C_{26}$-acrylates in the presence of ethylene-vinylacetate copolymers. Further examples comprise hyperbranched polymers comprising hydrophobic terminal groups.

Depending on the temperature, the dispersed phase may be solid, i.e. particles are dispersed in the aqueous phase, or liquid, i.e. droplets are dispersed in the aqueous phase.

The melting point of the paraffin inhibitor component is not more than 100° C. In one embodiment, the paraffin inhibitor component has a melting point from 10° C. to 95° C., in particular from 30° C. to 95° C., preferably from 40° C. to 80° C. and, for example, from 45° C. to 65° C. The melting point may be adjusted by the mixing ratio of paraffin inhibitors (X) and the organic solvent.

The $D_{50}$ particle size (volume size distribution) of the dispersed phase, measured by dynamic light scattering, is from 50 nm to 500 nm, preferably from 100 nm to 300 nm. The particle size measurement by dynamic light scattering was carried out according to ISO 22412:2017.

Details of the measurement procedure are described in the experimental part and we refer to said description.

Specific Paraffin Inhibitors (X)

Paraffin Inhibitor (X1)

In one embodiment of the invention, the polymeric paraffin inhibitor (X) is a paraffin inhibitor (X1) which is a copolymer comprising, as monomers,

- α-olefins having 10 to 60, in particular 10 to 32, preferably 12 to 28, more preferably 16 to 26, carbon atoms, and
- monoethylenically unsaturated monomers comprising carboxylate groups, where some or all of the carboxylate groups have been reacted with aliphatic, cycloaliphatic or aromatic alcohols and/or primary amines, with the proviso that at least 50 mol % of the alcohols or primary amines are linear aliphatic alcohols or linear aliphatic amines 16 to 32, preferably 16 to 26, carbon atoms.

The monomers having carboxylate groups may, for example, be acrylic acid, methacrylic acid, maleic acid, fumaric acid or itaconic acid, or salts thereof. Preference is given to maleic acid.

Copolymers comprising maleic acid units of this kind are obtainable by reacting copolymers of α-olefins and maleic anhydride, followed by polymer-analogous reaction of the maleic anhydride units with alcohols. Preference is given here to using not more than one equivalent of alcohol and/or primary amine per maleic anhydride unit, such that the esters or amides are essentially monoalkyl esters or monoalkyl amides. Suitable copolymers of α-olefins and maleic anhydride comprise especially 40 mol % to 60 mol %, preferably 45 mol % to 55 mol %, of α-olefins and 60 mol % to 40 mol %, preferably 55 mol % to 45 mol %, of maleic anhydride.

In one embodiment of the invention, the polymeric paraffin inhibitor (X1) is a copolymer comprising, as monomers,

- 40 to 60 mol % of α-olefins having 10 to 28, preferably 12 to 26, carbon atoms, and
- 60 to 40 mol % of maleic acid or salts thereof, where some or all of the carboxylate groups have been reacted with aliphatic, cycloaliphatic and/or aromatic alcohols and/or primary amines, with the proviso that at least 50 mol % of the alcohols and/or primary mines are linear aliphatic alcohols and/or linear primary amines having 16 to 32 carbon atoms.

Preferably, alcohols are used.

Preferably 30 mol % to 60 mol %, especially 40 mol % to 50 mol %, of the carboxylate groups have been reacted with alcohols or primary amines, preferably with alcohols, meaning that the maleic acid-based units are essentially monoalkyl maleates or monyalkyl maleic acid amides. In addition, a small amount of dialkyl maleates or dialkylmaleic acid amides, unconverted maleic anhydride units and possibly maleic acid or salts thereof may be present.

The linear aliphatic alcohols or linear aliphatic primary amides having 16 to 32 carbon atoms, preferably 16 to 26 carbon atoms, may of course be mixtures of different alcohols or amines.

Preferably, mixtures of different alcohols may be used. These may especially be mixtures of naturally occurring fatty alcohols or wax alcohols. Fatty alcohols or wax alcohols from natural sources typically have an even number of carbon atoms. In one embodiment of the invention, a mixture of at least three alcohols is used, comprising at least 1-docosyl alcohol, 1-tetracosylalkohol and 1-hexacosyl alcohol.

In one embodiment, the alcohols used for esterification are exclusively linear aliphatic alcohols having 16 to 32, preferably 16 to 26, carbon atoms.

In a further embodiment of the invention, esterification is accomplished using a mixture comprising 50 to 90 mol % of linear aliphatic alcohols having 16 to 32 carbon atoms and 10 mol % to 50 mol % of different linear, branched or cyclic aliphatic alcohols or aromatic alcohols. Additional alcohols of this kind may especially be linear aliphatic alcohols having 4 to 10 carbon atoms, branched and/or secondary aliphatic alcohols having 4 to 32 carbon atoms, unsubstituted or alkyl-substituted, cyclic aliphatic alcohols having 5 to 18 carbon atoms or unsubstituted or alkyl-substituted aromatic alcohols having 6 to 36 carbon atoms.

In a another embodiment of the invention, amidation is accomplished using a mixture comprising 50 to 90 mol % of linear aliphatic primary amines having 16 to 32 carbon atoms and 10 mol % to 50 mol % of different linear, branched or cyclic aliphatic primary amines or aromatic amines.

The weight-average molecular weight $M_w$ of the paraffin inhibitors (X1) may be selected by the skilled artisan according to his/her needs. In one embodiment of the invention, $M_w$ is from 2,000 g/mol to 25,000 g/mol.

Paraffin Inhibitor (X2)

In another embodiment of the invention, the polymeric paraffin inhibitor (X) is a paraffin inhibitor (X2).

The polymeric paraffin inhibitor (X2) comprises monoethylenically unsaturated monomers comprising at least alkyl(meth)acrylates of the general formula $H_2C{=}C(R^1){-}COOR^2$ (I), wherein $R^1$ is H or a methyl group and $R^2$ is a linear alkyl group having 12 to 60 carbon atoms.

The alkyl groups $R^2$ in particular comprise 12 to 36 carbon atoms, preferably 14 to 30 carbon atoms and more preferably 16 to 26 carbon atoms. Of course, two or more than 2 different groups $R^2$ may be present.

In one embodiment, besides the alkyl(meth)acrylates of the general formula (I) alkyl(meth)acrylates $H_2C{=}C(R^1){-}COOR^3$ (II) may be present, wherein is $R^3$ is an alkyl group selected from cyclic or branched alkyl groups having 1 to 36 carbon atoms or linear alkyl groups having 1 to 11 carbon atoms. If present, preferably their amount is not more than 50 mol %, relating to the total of all alkyl(meth)acrylates of formulas (I) and (II).

Paraffin Inhibitor (X3)

In another embodiment of the invention, the polymeric paraffin inhibitor (X) is a paraffin inhibitor (X3).

The polymeric paraffin inhibitor (X3) is available by radical polymerization of alkyl(meth)acrylates of the general formula $H_2C{=}C(R^1){-}COOR^2$ (I), wherein $R^1$ is H or a methyl group and $R^2$ is a linear alkyl group having 12 to 36 carbon atoms in the presence of ethylene-vinylester copolymers.

Alkyl(meth)acrylates of the general formula $H_2C{=}C(R^1){-}COOR^2$ (I) including preferred embodiments have already been described above and we refer to said embodiment. In addition alkyl(meth)acrylates of the general formula $H_2C{=}C(R^1){-}COOR^3$ (II) may be present for which we also refer to the description above.

The ethylene-vinylester copolymer preferably is an ethylene-vinylacetate copolymer. The amount of ethylene preferably is from 55 to 85% by weight, relating to the total of all monomers in the ethylene-vinylester copolymer.

Although we do not wish to be bound to a particular theory, this method yields a copolymer, in which there is at least partial grafting of the alkyl(meth)acrylates onto the ethylene-vinylester copolymer in the course of polymerization. A further portion of the monomers may polymerize without being grafted on. This gives rise to ethylene-vinyl ester graft copolymers with side groups alkyl(meth)acrylates, and homo- or copolymers comprising alkyl(meth) acrylates.

In general, the amount of the alkyl(meth)acrylates is 70 to 90% by weight and that of the ethylene-vinyl ester copolymers 10 to 30% by weight. Preferably, the amount of the monomers (A) is 75 to 85% by weight and that of the ethylene-vinyl ester copolymers (B) 15 to 25% by weight.

Paraffin Inhibitor (X4)

In another embodiment of the invention, the polymeric paraffin inhibitor (X) is a paraffin inhibitor (X4).

The paraffin inhibitor (X4) is a copolymer comprising at least ethylene and a vinyl ester of the general formula $H_2C{=}CH{-}O{-}(O)C{-}R^4$ (I) where $R^4$ is H or a $C_1$- to $C_4$ alkyl moiety. Preferably $R^4$ is a methyl moiety.

The paraffin inhibitors (X4) can be manufactured by radical polymerization under high-pressure conditions using suitable initiators for radical polymerization for example in stirred high-pressure autoclaves or in high-pressure tube reactors. Details of the manufacture have been described in WO 2015/124529 A1 and the literature cited therein.

Paraffin Inhibitor (X5)

In another embodiment of the invention, the polymeric paraffin inhibitor (X) is a paraffin inhibitor (X5).

The paraffin inhibitor (X5) is a copolymer comprising at least ethylene, a vinyl ester of the general formula $H_2C{=}CH{-}O{-}(O)C{-}R^4$ (I) where $R^4$ is H or a $C_1$- to $C_4$ alkyl moiety and a (meth)acrylate of the general formula $H_2C{=}C(R^6){-}COOR^6$ wherein $R^6$ is H or methyl, and $R^6$ is an alkyl moiety having from 4 to 18 carbon atoms.

Preferably $R^4$ is a methyl moiety and $R^6$ is selected from the group of

- $R^{6a}$: branched alkyl moieties having 4 to 18 carbon atoms,
- $R^{6b}$: cyclic alkyl moieties having 5 to 12 carbon atoms, and
- $R^{6c}$: alkyl substituted aryl moieties having 6 to 12 carbon atoms.

Preferably, $R^6$ is selected from $R^{6a}$ and $R^{6b}$.

In one embodiment of the invention the amounts of the monomers are as follows:

| | ethylene | vinylester | (meth)acrylate |
|---|---|---|---|
| composition | 70 to 99 | 0.5 to 29.5 | 0.5 to 15 |
| Preferred composition | 80 to 97 | 2.5 to 20 | 0.5 to 10 |
| More preferred composition | 83.5 to 96.5 | 3 to 11.5 | 0.5 to 5 |

Amounts of monomers in mol %

In one embodiment of the invention, the weight average molecular weight $M_w$ of the copolymer (A) is from 35,000 g/mol to 150,000 g/mol or from 50,000 g/mol to 120,000 g/mol.

The paraffin inhibitors (X4) can be manufactured by radical polymerization under high-pressure conditions using suitable initiators for radical polymerization for example in stirred high-pressure autoclaves or in high-pressure tube reactors. Details of the manufacture have been described in WO 2015/124529 A1 and the literature cited therein.

Paraffin Inhibitor (X6)

In another embodiment of the invention, the polymeric paraffin inhibitor (X) is a paraffin inhibitor (X6).

The paraffin inhibitor (X6) is a hyperbranched or dendritic polymer which comprises terminal hydrophobic groups. It is available by synthesizing a hyperbranched or dendritic core followed by hydrophobic modification of the terminal groups. Such polymers have been described for example in EP 1 557 411 A2.

Specifically, the paraffin inhibitor (X6) is a hyperbranched polyester obtainable by (a) reacting a hydroxyl group containing carboxylic acid with at least one carboxylic acid group and at least two hydroxyl groups with a diol having a molecular weight of more than 100 g/mol, optionally in the presence of at least one further reactant, wherein the at least one further reactant is a polyol having at least three hydroxyl groups under a reaction condition allowing ester and ether formation; and (b) reacting the mixture resulting from step (a) with a hydrophobic carboxylic acid resulting in the hyperbranched polyester mixture.

The carboxylic acids preferably have the general formula $R^7$—COOH, wherein $R^7$ is a hydrocarbon radical with at least 10, preferably at least 12 carbon atoms. More preferably, $R^7$ is moiety having 12 to 32 carbon atoms, preferably 12 to 26, for example 16 to 22 carbon atoms. Specific examples include stearic acid and palmitic acid.

At least trifunctional alcohols which can be reacted include for example the following: glycerol, butane-1,2,4-triol, n-pentane-1,2,5-triol, n-pentane-1,3,5-triol, n-hexane-1,2,6-triol, n-hexane-1,2,5-triol, n-hexane-1,3,6-triol, trimethylolbutane, trimethylolpropane or di-trimethylolpropane, trimethylolethane, pentaerythritol or dipentaerythritol; sugar alcohols such as mesoerythritol, threitol, sorbitol, mannitol, for example, or mixtures of the above at least trifunctional alcohols.

Examples of carboxylic acids comprise 2,2-bis(hydroxymethyl)propionic acid (dimethylolpropionic acid), 2,2-bis(hydroxy-methyl)butyric acid (dimethylolbutyric acid) and 2,2-bis(hydroxymethyl)valeric acid, preferably 2,2-bis(hydroxymethyl)propionic acid (dimethylolpropionic acid) or 2,2-bis(hydroxymethyl)butyric acid (dimethylolbutyric acid) and with particular preference 2,2-bis(hydroxymethyl)butyric acid (dimethylolbutyric acid) and 2,2-dihydroxymethylpropionic acid (dimethylolpropionic acid), even more preferred is dimethylolpropionic acid.

Diols are for example pentane-1,3-diol, pentane-1,4-diol, pentane-1,5-diol, pentane-2,3-diol, pentane-2,4-diol, hexane-1,2-diol, hexane-1,3-diol, hexane-1,4-diol, hexane-1,5-diol, hexane-1,6-diol, hexane-2,5-diol, heptane-1,2-diol 1,7-heptanediol, 1,8-octanediol, 1,2-octanediol, 1,9-nonanediol, 1,10-decanediol, 1,2-decanediol, 1,12-dodecanediol, 1,2-dodecanediol, 1,5-hexadiene-3,4-diol, cyclopentanediols, cyclohexanediols, inositol and derivatives, 2-methyl-2,4-pentanediol, 2,4-dimethyl-2,4-pentanediol, 2-ethyl-1,3-hexanediol, 2,5-dimethyl-2,5-hexanediol, 2,2,4-trimethyl-1,3-pentanediol, pinacol, diethylene glycol, triethylene glycol, dipropylene glycol, tripropylene glycol, polyethylene glycols $HO(CH_2CH_2O)_n$—H, polypropylene glycols $HO(CH[CH_3]CH_2O)_n$—H, polyTHF HO—$[(CH_2)_4$—$O]_n$—H or mixtures of two or more representatives of the above compounds, n being an integer with a value adjusted to meet the molecular weight of the polymer.

The manufacture of said hyperbranched polyesters is described in detail in WO 2019/185401 A1.

Paraffin Inhibitor Components Comprising Organic Solvents

The polymeric paraffin inhibitors (X) may be used as such or they may be used in a mixture with hydrocarbons or hydrocarbon mixtures, having a boiling point of at least 100° C., in particular at least 120° C., preferably at least 150° C. These may be aliphatic, cycloaliphatic and/or aromatic hydrocarbons or hydrocarbon mixtures. Preference is given to using hydrocarbons having a flashpoint of ≥60° C.

This approach has several advantages: firstly, the polymeric paraffin inhibitors can advantageously be prepared in solvents of this kind, and it is advantageous not to have to remove the solvents. The dissolution of the paraffin inhibitor component in the crude oil is also made easier when the polymeric paraffin inhibitor (X) is already in a mixture with an organic solvent. Finally, the desired melting point of the paraffin inhibitor component can be adjusted in a simple manner via the nature of the organic solvent and the mixing ratio of organic solvent and polymeric paraffin inhibitor (X). It is of course also possible to use mixtures of different organic solvents.

In one embodiment, the hydrocarbons are aliphatic or cycloaliphatic. Preference is given to high-boiling aliphatic hydrocarbons having a boiling point of at least 175° C. and preferably a flashpoint of ≥60° C. It is especially possible to use technical grade mixtures of hydrocarbons, for example mixtures of paraffinic hydrocarbons, mixtures of paraffinic and naphthenic hydrocarbons or mixtures of isoparaffins. It will be apparent to those skilled in the art that technical grade mixtures may still comprise small residues of aromatic or unsaturated hydrocarbons. The content of aromatic and/or unsaturated hydrocarbons should, however, be generally <1% by weight, preferably <0.5% by weight and more preferably <0.1% by weight. Technical grade mixtures of saturated aliphatic solvents are commercially available, for example technical grade mixtures of the Shellsol® D series or the Exxsol® D series.

In a further embodiment, the solvents may be aromatic solvents or solvent mixtures. Preference is given to high-boiling aromatic hydrocarbons having a boiling point of at least 175° C. and preferably a flashpoint of ≥60° C. It is especially possible to use technical grade mixtures of aromatic hydrocarbons. Technical grade mixtures of aromatic solvents are commercially available, for example technical grade mixtures of the Shellsol® A series or the Solvesso® series.

The paraffin inhibitor components may of course, as well as the polymeric paraffin inhibitors (X) and optionally organic, water-immiscible solvents, also comprise further constituents.

The mixing ratio of paraffin inhibitor component (X) and hydrocarbon or a hydrocarbon mixture can be adjusted by the person skilled in the art according to the desired properties, especially according to the desired melting point.

In one embodiment, the paraffin inhibitor component comprises from 30% by weight to 100%, preferably from 30% by weight to 90% by weight of the polymeric paraffin inhibitors (X), relating to the total of the paraffin inhibitor component and from 0% to 70% by weight, preferably from 10% by weight to 70% by weight, relating to the total of the paraffin inhibitor component—of a hydrocarbon or a hydrocarbon mixture.

In another embodiment, the paraffin inhibitor component comprises from 50% by weight to 90%, preferably from 60% by weight to 90% by weight of the polymeric paraffin inhibitors (X), relating to the total of the paraffin inhibitor component and from 10% by weight to 50% by weight, preferably from 10% by weight to 40% by weight, relating to the total of the paraffin inhibitor component—of a hydrocarbon or a hydrocarbon mixture.

The amount of the paraffin inhibitor component (X) is from 10% by weight to 60% by weight, or from 20% by weight to 50% by weight, based on the sum total of all the components of the aqueous dispersion, preferably from 25% by weight to 35% by weight.

Surfactants (S)

The aqueous dispersion according to the present invention furthermore comprises at least one surfactant (S).

The surfactant (S) is anionic and comprise at least one anionic group selected from sulfonate, sulfate, phosphonate or phosphate groups, preferably from sulfonate or sulfate groups. Of course, also a mixture of two or more than two different surfactants (S) may be used.

Examples of suitable surfactants (S) comprise for example alkali metal and ammonium salts of alkyl sulfates, of sulfuric monoesters of ethoxylated C8 to C18 alkanols (EO degree 2 to 30) and ethoxylated C4 to C12 alkylphenols (EO degree 3 to 50), of C8 to C18 alkylsulfonic acids and of C9 to C18 alkylarylsulfonic acids. Some compounds are known for example from U.S. Pat. No. 4,269,749, under the trade name Dowfax® 2A1 (Dow Chemical Company). Suitable surfactants also comprise alkali metal and ammonium salts of alkylphosphates, such as the mono- and diesters of phosphoric acid $H_3PO_4$ and a corresponding alcohol, which can carry linear or branched C8 to C20 alkyl groups, or C2 to C4 alkoxylated C1 to C20 alkyl or C4 to C18 alkylaryl groups. Further the surfactant comprises alkali metal and ammonium salts of C8 to C18 alkylphosphonates. In particular the surfactant comprises at least one anionic surfactant from the group of the salts of sulfuric monoesters of ethoxylated alkanols, having preferably a degree of ethoxylation in the range from 2 to 30, such as the sulfates of (poly)ethoxylated lauryl alcohol, of (poly)ethoxylated isotridecanol, of (poly)ethoxylated myristyl alcohol, of (poly)ethoxylated cetyl alcohol, and of (poly)ethoxylated stearyl alcohol.

Examples of preferred surfactants include alkylbenzene sulfonates, secondary alkyl sulfonates fatty acid sulfates, and alkyl ether sulfates, In one embodiment of the invention, the anionic surfactants comprise at least an alkyl ether sulfate having the general formula (I)

$$R^7—O—(CH_2CHR^3—O)_n—SO_3^-M^+ \quad (I)$$

wherein $R^7$ is linear, branched or cyclic alkyl group having 6 to 36 carbon atoms, preferably from 6 to 26 carbon atoms, $R^8$ is a group selected from H, methyl or ethyl, M is a monovalent counterion, and n is a number from 0 to 60, for example from 2 to 50 or from 2 to 20.

In one embodiment of the invention, at least 50 mol % of the groups $R^3$ are H, preferably at least 80 mol %, more preferably at least 90% and in one embodiment all of the group $R^3$ are H.

Branched alkyl groups $R^7$ may be derived from oxo alcohols or from Guerbet alcohols. Preferably, the groups $R^7$ are linear.

Monovalent counterions may be selected from $H^+$, alkali metal ions such as $Li^+$, $Na^+$, $K^+$, organic ammonium ions or $NH_4^+$. Preferably, M is selected from the group of $Li^+$, $Na^+$, $K^+$, $NH_4^+$ or organic ammonium ions, In one embodiment, the monovalent counterion is $Na^+$.

In one embodiment, wherein $R^7$ has 8 to 20 carbon atoms, and n is a number from 2 to 20.

In another embodiment, $R^7$ has 12 to 16 carbon atoms, $R^3$ is H, and n is a number from 2 to 6.

Of course, mixtures of two or more than two different surfactants (S) may be used. For example, mixtures of different surfactants (S) may be used, in which the alkyl radicals $R^7$ are derived from mixtures of fatty alcohols, for example surfactants of the general formula (I), wherein $R^7$ are $C_{12}$- and $C_{14}$ alkyl groups or $C_{16}$ and $C_{18}$ alkyl groups.

The amount of the anionic surfactants (S) is from 1 to 7% by weight relating to the total of all components of the paraffin inhibitor component. Preferably, the amount is from 2 to 7% by weight, or from 2.5% to 6.5% by weight. In one embodiment, the amount is from 3% by weight to 6.4% by weight.

Besides the anionic surfactants (S) in the mentioned amounts, optionally further surfactants different from the surfactants (S) may be added.

Examples of such further surfactants comprise non-ionic surfactants. Examples of non-ionic surfactants comprise Polyethylenoxide-polypropyleneoxide-polyethyleneoxide block copolymers (EO-PO-EO blockcopoylmers). Such blockcopolymers are commercially available with different amounts of ethylene oxide and different molar masses which are typically in the range from 1,000 g/mol to 10,000 g/mol. Examples comprise EO-PO-EO blockcopolymers, in which the PO-block has a molar mass of about 1750 g/mol and the amount of EO is from 40 to 80% by weight, or EO-PO-EO blockcopolymers, in which the PO-block has a molar mass of about 3250 g/mol and the amount of EO is about 50% by weight. Further examples comprise alkylpolyethylates having the general formula $R^9O—(CH_2CH_2O)_xH$, wherein $R^9$ is an alkyl group having 12 to 18 carbon atoms, and x is a number from 10 to 100. For example $R^9$ may be a linear alkyl group with 16 and/or 18 carbon atoms. In other embodiments $R^9$ may be an alkyl group derived from an oxo-alcohol, for example from a $C_{13}$ oxo alcohol.

Embodiments of the Aqueous Dispersion

In one embodiment of the invention, the aqueous dispersion comprises at least (A) a continuous aqueous phase comprising 20% to 70% by weight of water and 30 to 80% by weight of a water-miscible organic solvent selected from the group of ethylene glycol, diethylene glycol, 1,2-propylene glycol, 1,3-propylene glycol, ethylene glycol monomethyl ether or propylene glycol monomethyl ether, wherein the amount relate to the total of all components on the aqueous phase, and (B) a dispersed phase comprising at least one paraffin inhibitor component having a melting point of 30° C. to 95° C., wherein the amount of the paraffin inhibitor component is 20 to 50% by weight relating to the total of all components of the aqueous dispersion, and the paraffin inhibitor component comprises at least 60% to 90% by weight—relating to the total of the paraffin inhibitor component—of at least one polymeric, water-insoluble paraffin inhibitor (X), selected from the group of polymeric paraffin inhibitors (X1), (X2), (X3), (X4), (X5) and (X6), preferably (X1), (X3), (X4), (X5) and (X6), most preferably (X1), and 10% to 40% by weight—relating to the total of the paraffin inhibitor component—of a hydrocarbon or a hydrocarbon mixture having a boiling point of at least 120° C., wherein the $D_{50}$ particle size (volume size distribution) of the dispersed phase, measured by dynamic light scattering is from 100 nm to 300 nm, and (C) 2% to 7% by weight, preferably 2.5% to 6.5% by weight—relating to the paraffin inhibitor component—of at least one anionic surfactant (S), comprising at least one anionic group selected from sulfonate, sulfate, phosphonate or phosphate groups.

In one embodiment of the aqueous dispersion, the amount of water in the aqueous phase (A) is from 40% to 80% by weight, and the amount of water-soluble organic solvents is from 20% to 60% by weight, in each case based on the amount of all components of the aqueous phase, and the amount of the paraffin inhibitor component is from 30% to 50% by weight, relating to the total of all components of the aqueous dispersion. This embodiment relates to a more concentrated dispersion.

In another embodiment of the aqueous dispersion, the amount of water in the aqueous phase (A) is from 20% to 40% by weight, and the amount of water-soluble organic solvents is from 60% to 80% by weight, in each case based on the amount of all components of the aqueous phase, and wherein the amount of the paraffin inhibitor component is from 20% to 35% by weight, relating to the total of all components of the aqueous dispersion. This embodiment relates to a more diluted dispersion and the amount of water-soluble organic solvents in the aqueous phase is higher. By these measures, the melting point of the aqueous phase is lowered and the dispersion is more stable at low temperatures. So, the dispersion according to this embodiment, is especially adapted for use in extremely cold regions. In one embodiment, it is liquid also at −40° C., in other embodiments it is liquid even at temperature below −40° C.

Methods for Producing the Aqueous Dispersion

The aqueous dispersions basically may be prepared by any method. In the following, two methods will be described in more detail. Method A comprises distributing a pre-prepared paraffin inhibitor component in an aqueous phase, and method B comprises distributing monomers and optionally further components for making polymeric paraffin inhibitors in an aqueous phase followed by polymerization.

Method A:

In method A, the present invention relates to a process for producing an aqueous dispersion as described above which comprises (a1) Providing an oil-in-water emulsion by mixing the paraffin inhibitor component at a temperature above its melting point with at least water and the surfactant(s) (S) and distributing it in the aqueous phase, (a2) homogenizing the oil-in-water emulsion by means selected from the group of a homogenizer, ultrasound treatment, or a rotor-stator disperser, and (a3) adding a water-miscible organic solvent, wherein the addition may be carried out at any stage of the process.

Step (a1)

In course of step (a1), a paraffin inhibitor component as described above is mixed with the surfactant(s) (S) and at least water and distributed in the aqueous phase, thereby obtaining an oil-in-water emulsion, wherein the paraffin inhibitor component is distributed as droplets in a continuous aqueous phase. Distribution may, for example, be effected by means of stirring, such as a propeller stirrer. Besides water, already a part or all of the water-miscible organic solvent may be present.

The temperature at which the process step (a1) is carried out, depends on the melting point of the paraffin inhibitor component. If it is below room temperature, process step (a1) can be carried out at room temperatures. If the melting point is above room temperature, for example in the range from 30° C. to 95° C., it is necessary to heat the paraffin inhibitor component to a temperature above its melting point to mix it with the aqueous phase and the surfactant(s) (S).

For execution of the process, various procedures are conceivable in principle. For example, the paraffin inhibitor component and the surfactant(s) (S) can be mixed and optionally heated and the aqueous phase can be added to the pre-mixed mixture. A portion or the entire amount of the aqueous phase can also provided and the paraffin inhibitor component and the surfactant(s) (S) added to it. If only a part of the aqueous phase is used, the remainder is added at a later stage.

In certain embodiments of the invention, further components may be added optionally in course of step (a1). For example, neutralization agents may be added if the paraffin inhibitor component comprises acid functionalities. Adding neutralization agents may increase the surface charge and therefore the stability of the particle dispersion. The amount of neutralization agents necessary to deprotonate part or all of the acid groups can be calculated by the skilled artisan.

The minimum temperature to which heating is necessary is inevitably guided by the melting point of the paraffin inhibitor component. The temperature of the mixture must at least reach the melting point of the paraffin inhibitor component. Appropriately, the temperature to which heating is effected is at least 5° C. higher, preferably at least 10° C. higher, than the melting temperature of the paraffin inhibitor component. If preferred paraffin inhibitor components having a melting point of 45° C. to 65° C. are used, a temperature of 70° C. to 90° C. has been found to be useful.

Step (a2)

In course of step (a2), the oil-in-water emulsion is homogenized. In course of homogenizing the size of the droplets of the oil phase is reduced, so as to obtain an aqueous dispersion having the particle size as described above.

As shown in the examples, the particle size of the droplets in the oil-in-water emulsion roughly corresponds to the particle size of the particles in the final dispersion, So, adjusting the $D_{50}$ particle size (volume size distribution) of the dispersed phase (i.e. the droplets), measured by dynamic light scattering, to 50 nm to 500 nm, preferably to 100 nm to 400 nm in course of step (a2) is a good measure, to meet the particle size range of the final dispersion. If necessary, the skilled artisan may easily figure out the necessary particle size by a few tests.

The means for homogenizing the oil-in-water emulsion are selected from the group of a homogenizer, ultrasound treatment, or a rotor-stator disperser, preferably from a homogenizer, and ultrasound treatment, and most preferably a homogenizer is used. The homogenization may be carried out continuously or batchwise.

Rotor-stator dispersers are known in the art, for example as Ultra-Turrax®. The rotor is moved here with a high circumferential velocity. This rotation brings about suction, which sucks the medium into the rotor and pushes it outward through the teeth of the stator. This disperses the sample.

Homogenizers serve primarily for reduction and standardization of the particle size of an existing emulsion. For this purpose, a coarse emulsion is forced through the gap of a homogenizing valve or a plurality thereof. The gap between the valve seat and valve body is adjustable and is generally only a few micrometers. The fluid flows radially through the gap, with a considerable rise in the flow rate. After leaving the gap, the fluid generally hits an impact ring. The pressure is generally generated by a piston pump, especially by a piston pump having multiple pistons, for example having 3 pistons. Apparatus for this purpose are known in the art. This is for example described in U.S. Pat. No. 5,108,654. Homogenizers, such as Gaulin homogenizers or microfluidizers are commercially available.

In order to avoid separation of the oil-in-water emulsion generated in course of step (a1), it is advisable to continue mixing the oil-in-water emulsion until it passes the homogenizer. When the homogenizer is connected with a vessel for carrying out step (a1), it usually is sufficient to stir the vessel. The turbulences in a pipe connecting the homogenizer and the vessel usually are sufficient to avoid phase separation.

Means for ultrasound treatment are also known in the art. Ultrasound treatment may be carried out for example by means of a Hielscher ultrasound generator using a Sonotrode® H14 with 100% power at 400 W, while stirring the sample.

Step (a3)

Step (a3) comprises adding a water-miscible organic solvent as defined above, wherein the addition may be carried out at any stage of the process. The entire amount of water-miscible solvent may be added at one point of the process or several portions may be added at different points of the process.

In one embodiment, at least a part of the water-miscible organic solvent is present already during step (a1). Of course, also the entire amount may be present already during step (a1). In one embodiment, a part of the water-miscible organic solvent is added before or during step (a1) and another part is added after step (a2) or—if present—after step (a4).

Step (a4)

The process may optionally comprise a step (a4), which may be carried out if the melting point of the paraffin inhibitor component is above room temperature, for example in the range from 30° C. to 95° C. In course of step (a4), the homogenized oil-in-water emulsion as described above, is allowed to cool down to a temperature below the melting point of the paraffin inhibitor component. It is advisable to allow cooling the oil-in-water emulsion while stirring it or mixing it in another way.

So, in one embodiment, the present invention relates to a process for producing an aqueous dispersion as described above which comprises (a1) Providing an oil-in-water emulsion by mixing the paraffin inhibitor component having a melting point in the range from 30° C. to 95° C. at a temperature above its melting point with the surfactant(s) (S) and with at least water and distributing it in the aqueous phase, and (a2) homogenizing the oil-in-water emulsion by means selected from the group of a homogenizer, ultrasound treatment, or a rotor-stator disperser, (a3) adding a water-miscible organic solvent, wherein the addition may be carried out at any stage of the process, and (a4) allowing the mixture to cool down after step (a2) to a temperature below the melting temperature of the paraffin inhibitor component while stirring.

Method B:

In method B, the present invention relates to a process for producing an aqueous dispersion as described above, which comprises (b1) providing an oil-in-water emulsion by mixing at least monoethylenically unsaturated monomers for forming a polymeric, oil-soluble paraffin inhibitor (X) with the surfactant(s) (S) and at least a portion of the aqueous phase, and (b2) homogenizing the oil-in-water emulsion by means of a homogenizer, ultrasound treatment, or a rotor-stator disperser, and (b3) adding initiators for radical polymerization to the homogenized oil-in-water emulsion and polymerizing, thereby obtaining a paraffin inhibitor component which is a dispersed phase in a continuous aqueous phase.

Step (b1)

In course of step (b1), an oil-in-water emulsion is prepared by mixing at least monoethylenically unsaturated monomers for forming a polymeric, oil-soluble paraffin inhibitor (X) with the surfactant(s) (S) and at least a portion of the aqueous phase. Also, the monoethylenically unsaturated monomers are oil-soluble.

Suitable monoethylenically unsaturated monomers for forming a polymeric, oil-soluble paraffin inhibitors (X) are known in the art. Method B in particular is suitable for making the oil-soluble paraffin inhibitors (X2) and (X3).

Examples of suitable oil-soluble, monoethylenically unsaturated monomers for forming polymeric, oil-soluble paraffin inhibitors (X) comprise monomers $H_2C{=}C(R^1){-}COOR^2$ (I) and $H_2C{=}C(R^1){-}COOR^3$ (II) as described above. Further examples comprise styrene, vinyl toluene, vinyl pyridine, amino-functional monomers such as DMAEMA or also acidic monomers such as (meth)acrylic acid.

The monomers may be used as such, i.e. the oil phase of the resulting oil-in-water emulsion comprises only the monomers. In other embodiments, in course of step (b1) the monoethylenically unsaturated monomers are mixed with a hydrocarbon or a hydrocarbon mixture having a boiling point of at least 120° C. before emulsifying them in the aqueous phase. These may be aliphatic, cycloaliphatic and/or aromatic hydrocarbons or hydrocarbon mixtures. Preference is given to using hydrocarbons having a flashpoint of ≥60° C. Further details of such hydrocarbons or hydrocarbon mixtures have already been disclosed above.

In other embodiments, additionally a hydrophobic polymer is used in addition to the monoethylenically unsaturated monomers. In such a case, graft polymers are obtained. Examples of suitable polymers comprise ethylene-vinylester, for example ethylene-vinylacetate copolymers. Details about suitable ethylene-vinylester copolymers have been described above in the chapter about paraffin inhibitors (X3) and we refer to said passages.

The mixture my of course comprise further components such as for example chain-transfer agents.

The mixing ratio of the oil-soluble, monoethylenically unsaturated monomers, optionally polymers and further additives and organic solvent can be adjusted by the person skilled in the art according to the desired properties, especially according to the desired melting point of the resulting polymeric paraffin inhibitor (X). In general, however, the proportion of the monoethylenically unsaturated monomers, optionally polymers and further additives is at least 50% by weight based on the sum total of all components of the monomer mixture, especially 50% by weight to 90% by weight. Preferred monomer mixtures comprise 60% by weight to 80% by weight of polymeric paraffin inhibitors (X) and 20% by weight to 40% by weight of organic solvents.

Step (b2)

In course of step (b2), the oil-in-water emulsion obtained in course of step (b1) is homogenized. In course of homogenizing the particle size of the droplets of the oil phase is reduced. The homogenization may be carried out continuously or batchwise.

The means for homogenizing the oil-in-water emulsion are selected from the group of a homogenizer, ultrasound treatment, or a rotor-stator disperser, preferably from a homogenizer, and ultrasound treatment, and most preferably a homogenizer is used. Details have already been described above under (a2) and we refer to said passages.

As shown in the examples, the particle size of the particles in the final dispersion is a bit smaller than the size of the monomer droplets in the oil-in-water emulsion of the monomers. Nevertheless, the skilled artisan may easily figure out the necessary particle size by a few tests to meet the desired particle size of final dispersion.

Step (b3)

In course of step (b3), initiators for radical polymerization are added to the oil-in-water emulsion of monoethylenically unsaturated monomers, optionally polymers and further additives and polymerization is initiated, thereby obtaining an aqueous dispersion comprising a continuous aqueous phase and a dispersed phase comprising a paraffin inhibitor component comprising a polymeric paraffin inhibitor (X).

Step (b4)

The process may optionally comprise a step (b4), which may be carried out if the melting point of the paraffin inhibitor component is above room temperature, for example in the range from 30° C. to 95° C. In course of step (b4), the homogenized dispersion as described above, is allowed to cool down to a temperature below the melting point of the paraffin inhibitor component. It is advisable to allow cooling the oil-in-water emulsion while stirring it or mixing it in another way.

So, in one embodiment, the present invention relates to a process for producing an aqueous dispersion as described above, which comprises (b1) providing an oil-in-water emulsion by mixing at least monoethylenically unsaturated monomers for forming a polymeric, oil-soluble paraffin inhibitor (X) having a melting temperature from 30° C. to 95° C. with the surfactant(s) (S) and at least a portion of the aqueous phase, and (b2) homogenizing the oil-in-water emulsion by means of a homogenizer, ultrasound treatment, or a rotor-stator disperser, and (b3) adding initiators for radical polymerization to the homogenized oil-in-water emulsion and polymerizing, thereby obtaining a paraffin inhibitor component which is a dispersed phase in a continuous aqueous phase, and (b4) allowing the mixture to cool down to a temperature below the melting temperature of the paraffin inhibitor component while stirring.

Uses of the Aqueous Dispersions of Paraffin Inhibitors

The aqueous dispersion of paraffin inhibitors can be used for various purposes. For example, they can be used as paraffin inhibitor or pour point depressant for crude oil or other hydrocarbon fluids, such as fuel oils or diesel.

Certain embodiments are described in more detail in the following.

Use as a Pour Point Depressant for Crude Oil

The aqueous dispersions of the invention can be used as pour point depressants, by adding the aqueous dispersion to the crude oil.

For this purpose, the aqueous dispersion described above can be used as such. In another embodiment, it is of course still possible to dilute the compositions of the invention before use, for example with water and/or with water-miscible solvents.

The compositions can also be formulated together with further components. Examples of further components comprise corrosion inhibitors or scale inhibitors.

The amount of the aqueous dispersion added to the crude oil is judged by the person skilled in the art such that the desired lowering of the pour point is achieved, it being obvious to the person skilled in the art that the amount necessary is dependent on the nature of the crude oil. On the other hand, it is desirable for economic reasons to use a minimum amount of pour point depressant.

The amount of aqueous dispersion is generally such that the amount of the polymeric paraffin inhibitor (X) is 50 to 3,000 ppm, in particular 50 to 1,500 ppm based on the crude oil. The amount is preferably 100 to 1,000 ppm, more preferably 250 to 800 ppm and, for example, 300 to 600 ppm.

It is advisable here to add the aqueous dispersions to the crude oil before the first paraffin crystals form. The temperature at which the very first paraffin crystals form is also called WAT ("wax appearance temperature"). In one embodiment of the invention, the aqueous dispersions are therefore added at a temperature above the WAT, preferably at least 10° C. above the WAT.

The site of addition of the aqueous dispersion to the crude oil is suitably chosen by the person skilled in the art. The addition can be effected, for example, in the formation, in the well, at the wellhead or to a pipeline.

In one embodiment, the aqueous dispersion is injected into a crude oil pipeline. The injection can preferably be effected at the oilfield, i.e. at the start of the crude oil pipeline, but the injection can of course also be affected at another site. For example, the pipeline may be one leading onshore from an offshore platform. The aqueous dispersion can prevent blockage of pipelines if the crude oil cools down in the course of transport in the pipeline or shut-in during maintenance. This risk is naturally particularly pronounced when the pipeline is one in a cold environment, for example in an Arctic environment.

In a further embodiment of the invention, the aqueous dispersion is injected into a production well. In one embodiment, the production well may be an offshore production well. The injection can be effected, for instance, at the site where oil flows out of the formation into the production well. In this manner, the solidification of the crude oil in the production well and in downstream transport pipelines, an excessive increase in the viscosity thereof and the constriction of pipe cross sections by paraffin deposits can be prevented.

In one embodiment of the invention, the injection can be effected in an umbilical manner. This involves introducing a flexible string comprising at least one pipeline and optionally electrical wires or control wires in a protective shell axially into a well or a pipeline. The aqueous dispersion can be injected exactly at the desired site through the pipeline in the flexible string.

In one embodiment of the invention, the aqueous dispersion is diluted with an additional amount of a water-miscible organic solvent before using it. Suitable water-miscible organic solvents, including preferred embodiments, have already been described above.

Adding additional water-miscible organic solvents reduces the melting point of the aqueous dispersion which allows to use it in even colder regions. Dilution may be carried out at the location of use but it may also be carried out in course of production, so that a more diluted aqueous dispersion is provided to the location of use.

Use as Wax Inhibitor

In a further embodiment of the invention, the above-described aqueous dispersions are used to prevent wax deposits on surfaces in contact with crude oil, mineral oil and/or mineral oil products. These are preferably surfaces in contact with crude oil.

Use is effected by adding said aqueous dispersion to the crude oil. The manner of use is analogous to the use as a pour point depressant. As well as the aqueous dispersions of the invention, it is of course possible to use further paraffin inhibitors.

Use as Yield-Stress Improvers

In further embodiments, the aqueous dispersions can be used for reducing the yield stress of crude oil, in particular crude oil which is transported in a pipeline.

The yield stress is the stress which is necessary that oil starts to flow, for example in a pipeline. If the oil transport through a pipeline is interrupted, for example due to a failure of pumps, wax may crystallize from the oil thereby impairing its flow properties, and in particular increasing its yield stress. This may happen in particular for offshore pipelines in which the crude oil cools upon standing for a longer time to the water-temperature at the sea floor (which may be 4° C.). In the worst case, the pressure generated by the pumps when transport is to be resumed is not sufficient to overcome the yield stress of the crude oil.

Adding the aqueous dispersions described above reduces the yield stress and therefore eases restart of transport of crude oil through a pipeline.

For the purpose of reducing the yield stress of crude oil, in particular crude oil which is transported in a pipeline, the aqueous dispersions are added to the crude oil.

The amount of aqueous dispersion is generally such that the amount of the polymeric paraffin inhibitor (X) is 50 to 3,000 ppm, in particular 50 to 1,500 ppm based on the crude oil. The amount is preferably 100 to 1,000 ppm, more preferably 250 to 800 ppm and, for example, 300 to 600 ppm.

Use as Additive for Fuels and Fuel Oils

In one embodiment of the present invention, the aqueous dispersions as described above are used as additive for fuels and fuel oils.

In another embodiment, the present invention relates to a fuel or fuel oil, preferably a fuel oil, comprising at least one aqueous dispersion as described above, wherein the aqueous dispersion is used in such an amount that the concentration of the paraffin inhibitors (X) is from 10 ppm to 3,000 ppm by weight based on the fuel oil.

In the context of the present invention, the term "fuel" shall mean any kind of fuel of fossil, vegetable or animal origin, including but not limited gasoline and diesel. "Fuel oils" shall be understood to mean middle distillate fuels of fossil, vegetable or animal origin, biofuel oils ("biodiesel") and mixtures of such middle distillate fuels and biofuel oils.

Middle distillate fuels (also called "middle distillates" for short hereinafter) are especially understood to mean fuels which are obtained by distilling crude oil as the first process step and boil within the range from 120 to 450° C. Such middle distillate fuels are used especially as diesel fuel, heating oil or kerosene, particular preference being given to diesel fuel and heating oil. The middle distillates preferably have aromatics contents of below 28% by weight, especially below 20% by weight. The content of normal paraffins is between 5% by weight and 50% by weight, preferably between 10 and 35% by weight.

In the context of the present invention, middle distillate fuels shall also be understood here to mean those fuels which can either be derived indirectly from fossil sources such as mineral oil or natural gas, or else are produced from biomass via gasification and subsequent hydrogenation. A typical example of a middle distillate fuel which is derived indirectly from fossil sources is the GTL ("gas-to-liquid") diesel fuel obtained by means of Fischer-Tropsch synthesis. A middle distillate is prepared from biomass, for example, via the BTL ("biomass-to-liquid") process, and can be used as fuel either alone or in a mixture with other middle distillates. The middle distillates also include hydrocarbons which are obtained by the hydrogenation of fats and fatty oils. They comprise predominantly n-paraffins.

The qualities of the heating oils and diesel fuels are laid down in more detail, for example, in DIN 51603 and EN 590 (cf. also Ullmann's Encyclopedia of Industrial Chemistry, 5th edition, volume A12, p. 617 ff.).

In a preferred embodiment the fuel is a diesel fuel (absent any additives) with a CP value according to ASTM D2500/ASTM D97 of 0 to −15° C., preferably 0 to −10° C., and more preferably −5 to −10° C. and/or, preferably and with a content of n-paraffines of from 10 to 30% by weight, more preferably of from 15 to 25% by weight, and most preferably from 17 to 23% by weight.

In addition to its use in the middle distillate fuels of fossil, vegetable or animal origin mentioned, which are essentially hydrocarbon mixtures, the aqueous dispersion can also be used in biofuel oils and in mixtures of the middle distillates mentioned with biofuel oils, in order to improve cold flow characteristics. Mixtures of this kind are commercially available and usually comprise the biofuel oils in minor amounts, typically in amounts of 1% to 30% by weight, especially of 3% to 10% by weight, based on the total amount of middle distillate of fossil, vegetable or animal origin and biofuel oil.

Biofuel oils are generally based on fatty acid esters, preferably essentially on alkyl esters of fatty acids which derive from vegetable and/or animal oils and/or fats. Alkyl esters are preferably understood to mean lower alkyl esters, especially $C_1$- to $C_4$-alkyl esters, which are obtainable by transesterifying the glycerides which occur in vegetable and/or animal oils and/or fats, especially triglycerides, by means of lower alcohols, for example ethanol or in particular methanol ("FAME"). Typical lower alkyl esters which are based on vegetable and/or animal oils and/or fats and find use as a biofuel oil or components thereof are, for example, HVO (hydrogenated vegetable oil), sunflower methyl ester, palm oil methyl ester ("PME"), soya oil methyl ester ("SME") and especially rapeseed oil methyl ester ("RME").

The aqueous dispersion is usually added to the middle distillate fuels in such an amount that the concentration of the paraffin inhibitors (X) is from 10 to 10,000 ppm by weight.

It is possible, through the use of the aqueous dispersions according to the present invention, to improve a number of fuel properties. Mention shall be made here by way of example merely of the additional effect as a cloud point depressant (CPD) or as a booster together with a flow improver for further improvement of the CFPP.

In one embodiment, the fuels or fuel oils comprise additionally further additives selected from the group of cold flow improvers, paraffin dispersants, conductivity improvers, anticorrosion additives, lubricity additives, antioxidants, metal deactivators, antifoams, demulsifiers, detergents, cetane number improvers, solvents or diluents, dyes and fragrances.

In the context of present invention, flow improvers shall be understood to mean all additives which improve the cold properties of middle distillate fuels. As well as the actual cold flow improvers ("MDFI"), these are also nucleators (cf. also Ullmann's Encyclopedia of Industrial Chemistry, 5th edition, volume A16, p. 719 ff.).

When cold flow improvers are present, the inventive middle distillate fuels comprise these, in addition to the inventive copolymer, in an amount of typically 1 to 2,000 ppm by weight, preferably of 5 to 1,000 ppm by weight, especially of 10 to 750 ppm by weight and in particular of 50 to 500 ppm by weight, for example of 150 to 400 ppm by weight. Cold flow improvers of this kind are described, for example, in WO 2007/147753, particularly at page 13 line 1 to page 16, line 32 therein, which is hereby incorporated into the present disclosure by reference.

Preferred flow improvers are ethylene-vinyl acetate copolymers as described in WO 99/29748, or comb polymers as described in WO 2004/035715, and form, together with the inventive copolymer in its function as a paraffin dispersant, an efficient and versatile cold stabilization system for middle distillate fuels, especially for those having a proportion of biodiesel.

More preferably, the flow improvers are copolymers of ethylene with at least one further ethylenically unsaturated monomer, preferably selected from alkenyl carboxylates, (meth)acrylic esters, dialkyl maleates, dialkyl fumarates and olefins.

Most preferably, the flow improvers are ter- or quater-polymers of ethylene and at least one alkenyl carboxylate and with at least one further ethylenically unsaturated monomer, preferably selected from (meth)acrylic esters, dialkyl maleates, dialkyl fumarates and olefins.

Suitable olefins are, for example, those having 3 to 10 carbon atoms and having 1 to 3, preferably having 1 or 2, especially having one carbon-carbon double bond(s). In the latter case, the carbon-carbon double bond may either be terminal ($\alpha$-olefins) or internal. Preference is given, however, to $\alpha$-olefins, particular preference to $\alpha$-olefins having 3 to 6 carbon atoms, for example propene, 1-butene, 1-pentene and 1-hexene.

Suitable (meth)acrylic esters are, for example, esters of (meth)acrylic acid with $C_1$- to $C_{10}$-alkanols, especially with methanol, ethanol, propanol, isopropanol, n-butanol, sec-butanol, isobutanol, tert-butanol, pentanol, hexanol, heptanol, octanol, 2-ethylhexanol, nonanol and decanol.

Suitable alkenyl carboxylates are, for example, the vinyl and propenyl esters of carboxylic acids having 2 to 20 carbon atoms, wherein the hydrocarbyl radical may be linear or branched. Among these, preference is given to the vinyl esters. Among the carboxylic acids having a branched hydrocarbyl radical, preference is given to those wherein the branch is in the a position to the carboxyl group, the a carbon atom more preferably being tertiary, meaning that the carboxylic acid is what is called a neocarboxylic acid. However, the hydrocarbyl radical of the carboxylic acid is preferably linear.

Examples of suitable alkenyl carboxylates are vinyl acetate, vinyl propionate, vinyl butyrate, vinyl 2-ethylhexanoate, vinyl neopentanoate, vinyl hexanoate, vinyl neononanoate, vinyl neodecanoate and the corresponding propenyl esters, preference being given to the vinyl esters. A particularly preferred alkenyl carboxylate is vinyl acetate; typical copolymers that result therefrom are ethylene-vinyl acetate copolymers ("EVA"), which are used on a large scale and diesel fuels. More preferably, the ethylenically unsaturated monomer is selected from alkenyl carboxylates.

Examples of dialkyl maleates and dialkyl fumarates are the methyl, ethyl, n-propyl, isopropyl, n-butyl, sec-butyl, isobutyl, n-pentyl, n-hexyl, 2-ethylhexyl and 2-propylheptyl esters of maleic acid or fumaric acid, these being mixed or preferably identical esters, i.e. in the case of alkyl radicals are the same.

Also suitable are copolymers comprising two or more different alkenyl carboxylates in copolymerized form, these differing in terms of the alkenyl function and/or in terms of the carboxylic acid group. Likewise suitable are copolymers which, as well as the alkenyl carboxylate(s), comprise at least one olefin and/or at least one (meth)acrylic ester in copolymerized form.

The ethylenically unsaturated monomer is copolymerized within the copolymer in an amount of preferably 1 to 50 mol %, especially of 10 to 50 mol % and in particular of 5 to 20 mol %, based on the overall copolymer.

The copolymers preferably have a number-average molecular weight $M_n$ of 1,000 to 20,000, more preferably of 1,000 to 10,000 and especially of 1,000 to 6,000.

In addition to its use in the middle distillate fuels of fossil, vegetable or animal origin mentioned, which are essentially hydrocarbon mixtures, the aqueous dispersions can also be used in biofuel oils and in mixtures of the middle distillates mentioned with biofuel oils, in order to improve cold flow characteristics. Mixtures of this kind are commercially available and usually comprise the biofuel oils in minor amounts, typically in amounts of 1% to 30% by weight, especially of 3% to 10% by weight, based on the total amount of middle distillate of fossil, vegetable or animal origin and biofuel oil.

Biofuel oils are generally based on fatty acid esters, preferably essentially on alkyl esters of fatty acids which derive from vegetable and/or animal oils and/or fats. Alkyl esters are preferably understood to mean lower alkyl esters, especially $C_1$- to $C_4$-alkyl esters, which are obtainable by transesterifying the glycerides which occur in vegetable and/or animal oils and/or fats, especially triglycerides, by means of lower alcohols, for example ethanol or in particular methanol ("FAME"). Typical lower alkyl esters which are based on vegetable and/or animal oils and/or fats and find use as a biofuel oil or components thereof are, for example, HVO (hydrogenated vegetable oil), sunflower methyl ester, palm oil methyl ester ("PME"), soya oil methyl ester ("SME") and especially rapeseed oil methyl ester ("RME").

In one embodiment, the aqueous dispersions of the present invention are used for reducing the crystallization of paraffin crystals in fuels or fuel oils, preferably in fuel oils, by adding at least the aqueous dispersion as described above to the fuels. Typical amounts of paraffin inhibitors (X) to be added have already been mentioned above.

In another embodiment, the aqueous dispersions are used for improving the cold flow properties of fuel or fuel oils, preferably of fuel oils, and/or for improving the filterability of fuel or fuel oils, preferably of fuel oils, by adding at least the aqueous dispersion described above to the fuel oils. Typical amounts of paraffin inhibitors (X) to be added have already been mentioned above.

Advantages of the Invention

The advantage of such a dispersion is that it has a much better EHS profile which allows for easier handling and storage. Further, it allows to dose the active additive at higher concentration at lower viscosity than pure organic solvent-based solutions, especially at low temperatures.

The following examples are deemed to further illustrate the invention:

Test Methods

Particle Size Distribution

Particle size distributions were measured for the emulsion after homogenization or ultrasound treatment and for the final product.

The particle sizes/particle diameters or particle radii indicated here for the polymer particles are particle diameters and were determined by means of photon correlation spectroscopy (PCS), also known as quasi-elastic light scattering (QELS) or dynamic light scattering. In the present invention, particle size was determined by using a NANO-Flex particle sizer from Microtrac (Microtrac Retsch GmbH, Haan, Germany) using a 780 nm laser light (3 mW) at a 180° scattering angle. Measurements were done with samples tel quel diluted to the required concentration, determined by the equipment, with demineralized water at room temperature. A measurable concentration for the equipment is typically reached when ca. 3 drops of the sample were dispersed in 10 ml of demineralized water. The values reported are D50 values in nm (50% of the particles≤the D50 value) of the particle population based on their volume size distribution.

Dynamic Viscosity

The dynamic viscosity of the dispersion was determined using a Brookfield viscosimeter (model DV-E). A sample of 150 ml was brought to the desired temperature (20 or 23° C.) using a thermostat bath. The LV-type spindle belonging to the range to be measured was connected to the Brookfield viscosimeter, and immersed slowly into the sample until the mark on the spindle was on the same level as the surface of the liquid to be measured. The measurement speed was set in the range of 50 to 100 rpm. The measurement was started and the value shown on the display was recorded.

Molecular Weight Determination

GPC was measured on an Agilent 1260 Infinity apparatus against polystyrene standards in 5 mg/ml THF solutions on 2 sequential PolyPore 300 mm×7.5 mm Agilent columns at 40° C. and 1 ml/min flow. Detection of the signals was done by refractive index and the data were processed using Agilent GPC/SEC Software Version 1.2.

Synthesis of Aqueous Dispersions

Starting Materials

| Component | Chemical description |
|---|---|
| Behenylacrylate | Mixture of linear C18, C20, C22 alkylacrylates (C16 0-5% C18 40-55%, C20 0-15%, C22 35-45% by weight) |
| Stearylacrylate | Mixture of linear C16, C18 alkylacrylates (C14 0-3%, C16 47-52%, C18 42-48% by weight) |
| EVA-1 | copolymer of 67% by weight of ethylene and 33% by weight of ethylene acetate, Melt Index (190° C., 2, 16 kg) 21 g/10 min |
| EVA-2 | copolymer of 70% by weight of ethylene and 30% by weight of ethylene acetate, melt viscosity @ 120° C. = 70 mPas |
| Solvesso ® 150 ND | Mixture of high boiling aromatic hydrocarbons, distillation range 183° C. to 194° C., flash point 64° C. |
| Shellsol ® D70 | Mixture of high-boiling aliphatic hydrocarbons (predominantly $C_{11-14}$ paraffins), initial boiling point 203° C., dry point 237° C., flash point 78° C. |
| Brüggolite ® FF6M | Commercially reducing agent (sulfinic acid derivative) |
| Anionic surfactant 1 | Aqueous solution comprising 31 wt.-% of $n\text{-}C_{12/14}\text{—O—}(CH_2CH_2O)_4SO_3Na$ $n\text{-}C_{12/14}$ are linear alkyl groups having 12 and 14 carbon atoms |
| Non-ionic surfactant 1 | $n\text{-}C_{16/18}\text{—O—}(CH_2CH_2O)_{11}H$ $n\text{-}C_{16/18}$ are linear alkyl groups having 18 and 18 carbon atoms |
| Non-ionic surfactant 2 | $i\text{-}C_{13}\text{—O—}(CH_2CH_2O)_7H$ $i\text{-}C_{13}$ is the branched alkyl group of a $C_{13}$ oxo alcohol |
| Non-ionic surfactant 3 | $n\text{-}C_{16/18}\text{—O—}(CH_2CH_2O)_{50}H$ |
| t-dodecylmercaptane | chain transfer agent |
| t-butylhydroperoxide | radical initiator |
| 1,2 propanediol | water-miscible organic solvent |
| Monoethylene glycol | water-miscible organic solvent |
| KOH | neutralization agent |

Method A

Dispersion of a Dre-Prepared Pour Point Depressant in an Aqueous Phase

EXAMPLE 1

Aqueous Dispersion of an Esterified Copolymer of Maleic Acid Anhydride and $C_{20/24}$ Olefines (Paraffin Inhibitor Type (X1)) in Solvesso® 150 ND (Polymer Solvent 75/25 wt/wt) Stabilized by 4 Wt.-% of Anionic Surfactant (25 wt.-% of Polymer in Dispersion)

(The Percentages Relate to the Total of all Components)

Synthesis of the Paraffin Inhibitor Component

In a 1$^{st}$ step, 271 g of maleic acid anhydride and 829 g of a commercially available mixture of $C_{20}$ to $C_{24}$ α-olefines are radically polymerized at a temperature of about 140° C. by adding 11.2 g of di-tert-butyl peroxide within a period of 5 h, thereby obtaining a copolymer of maleic acid anhydride and $C_{20/24}$ α-olefines.

In a 2$^{nd}$ step, 775.5 g Solvesso® 150 ND and 1347.3 g of Behenyacrylate is added at a temperature of 145° C. to the prepolymer obtained in the 1$^{st}$ step and the mixture stirred for about 8 h. The alcohols react with the maleic acid anhydride groups under ring opening thereby yielding maleic acid ester groups.

The product comprises 75 wt.-% of a maleic acid ester-olefine copolymer ($M_w$~18,000 g/mole) and the remainder is Solvesso® ND 150. The melting point of the mixture is about 40° C.

Preparation of an Aqueous Dispersion

For the preparation of a stable oil/water emulsion 249.6 g of the melted paraffin inhibitor component was placed into a pre-heated reactor at 65° C. While stirring, 32.2 g of an aqueous solution of the anionic surfactant 1 (31 wt.-%) were added slowly, followed by 129 g of water and 92 g of 1,2-propanediol. After stirring for 15 min, a preheated (60° C.) solution of 3.2 g of solid KOH in 130 g of water and 104 g of 1,2-propanediol was added slowly and stirred for another 15 min.

Subsequently, the warm pre-emulsion was poured into the addition funnel of a Gaulin type homogenizer (APV 1000 SPX Flow) and while stirring in the funnel, directly treated once at 500 bar valve setting and at 60° C., resulting into a stable emulsion with a D50 droplet size of 246 nm which was collected from the homogenizer via the exit tube into a transport flask.

The warm emulsion was directly placed back in a reactor and cooled to RT under stirring over one hour.

Afterwards it was filtered via a 125 μm filter into a container. No coagulum was found. The final dispersion was obtained as a white opaque, slightly viscous liquid.

The resulting particle size of the dispersion $D_{50}$ was monomodal at 269 nm and the pH was 6.9. The dynamic viscosity of the aqueous dispersion was 40 mPas (at 23° C.).

The obtained dispersion comprises (the numbers relate to the total of all components of the aqueous dispersion):

| | |
|---|---|
| Paraffin inhibitor component (polymer + org. solvent) | 33.7 wt.-% |
| polymer (75 wt.-% of paraffin inhibitor component) | 25.3 wt.-% |
| Anionic surfactant | 1.3 wt.-% |
| Water | 38.0 wt.-% |
| Propanediol | 26.5 wt.-% |
| KOH | 0.4 wt.-% |

The amount of anionic surfactant relating to the paraffin inhibitor component (comprising polymer and organic solvent (see above)) was 4 wt.-%. The proportion of water/propanediol (wt./wt.) was 59:41.

EXAMPLE 2

Aqueous Dispersion of an Esterified Copolymer of Maleic Acid Anhydride and $C_{20/24}$ Olefines (Paraffin Inhibitor Type (X1) in Solvesso® 150 ND (Polymer/Solvent 75/25 wt/wt) Stabilized by 4 Wt.-% of Anionic Surfactant (35 wt.-% of Polymer in Dispersion)

(The Percentages Relate to the Total of all Components)

Synthesis of the Paraffin Inhibitor Component

The synthesis was carried out as in example 1.

Preparation of an Aqueous Dispersion

For the preparation of a stable oil/water emulsion 328 g of melted paraffin inhibitor component 1 was placed into a pre-heated reactor at 65° C. While stirring, 42.3 g of an aqueous solution of the anionic surfactant 1 (31 wt.-%) was added slowly, followed by 134 g of water and 110 g of 1,2-propanediol. After stirring for 15 min, a preheated (60° C.) solution of 4.19 g of solid KOH in 41.9 g of water and 41.9 g of 1,2-propanediol was added slowly and stirred for another 15 min.

Subsequently, the warm pre-emulsion was poured into the addition funnel of a Gaulin type homogenizer (APV 1000 SPX Flow) and while stirring in the funnel, directly treated once at 500 bar valve setting and at 60° C., resulting into a stable emulsion with a D50 droplet size of 280 nm, which was collected from the homogenizer via the exit tube into a transport flask.

Afterwards it was filtered via a 125 μm filter into a container. No coagulum was found. The final dispersion was obtained as a white opaque, slightly viscous liquid.

The warm emulsion was directly placed back in a reactor and cooled to RT under stirring over one hour.

The resulting particle size of the dispersion $D_{50}$ was monomodal at 278 nm, and the pH was 7.0. The dynamic viscosity of the aqueous dispersion was 100 mPas (at 23° C.).

The obtained dispersion comprises (the numbers relate to the total of all components of the aqueous dispersion):

| | |
|---|---|
| Paraffin inhibitor component (polymer + org. solvent) | 46.7 wt.-% |
| polymer (75 wt.-% of paraffin inhibitor component) | 35 wt.-% |
| Anionic surfactant | 1.9 wt.-% |
| Water | 29.2 wt.-% |
| Propanediol | 21.6 wt.-% |
| KOH | 0.6 wt.-% |

The amount of anionic surfactant relating to the paraffin inhibitor component (comprising polymer and organic solvent (see above)) was 4.0 wt.-%. The proportion of water/propanediol (wt./wt.) was 57:43.

EXAMPLE 3

Aqueous Dispersion of an Esterified Copolymer of Maleic Acid Anhydride and $C_{20/24}$ Olefines (Paraffin Inhibitor Type (X1) in Solvesso® 150 ND (Polymer/Solvent 60/40 wt/wt) Stabilized by 4 Wt.-% of Anionic Surfactant (25 wt.-% of Polymer in Dispersion)

Synthesis of the Paraffin Inhibitor Component

The synthesis was carried out as in example 1.

Preparation of an Aqueous Dispersion

In a first step, 62.4 g of melted paraffin inhibitor component were placed into a pre-heated reactor at 70° C. and 15.6 g of Solvesso®150 ND were added, thereby obtaining a more diluted paraffin inhibitor component which comprises 60 wt.-% of the polymer and 40 wt.-% Solvesso® 150 ND.

While stirring, 10.1 g of an aqueous solution of the anionic surfactant 1 (31 wt.-%) was added slowly, followed by 27.1 g of water and 22.6 g of 1,2-propanediol. After stirring for 15 min, a preheated (60° C.) solution of 0.8 g of solid KOH in 26.8 g of water and 19.6 g of 1,2-propanediol was added slowly and stirred for another 15 min.

Subsequently, the warm pre-emulsion was poured into a beaker of 200 ml, a stirring rod was added and kept at 60° C., in order to be treated with ultrasound using a Hielscher ultrasound generator UP400S (400 Watt, 24 kHz) with a Sonotrode H14 with a max. amplitude of 125 μm. The tip of the ultrasound probe was immersed for 2 cm deep into the liquid and the magnetic stirrer engine was started ensuring a efficient homogenization. The pre-emulsion was treated at 50% power for 20 minutes and this resulted into a stable emulsion. After this time the stirrer was stopped and the warm emulsion was placed back in a reactor and cooled to RT under stirring over one hour. Afterwards it was filtered via a 125 μm filter into a container. No coagulum was found. The final dispersion was obtained as a white opaque, slightly viscous liquid.

The resulting particle size of the dispersion $D_{50}$ was monomodal at 160 nm.

The obtained dispersion comprises (the numbers relate to the total of all components of the aqueous dispersion):

| | |
|---|---|
| Paraffin inhibitor component (polymer + org. solvent) | 42.2 wt.-% |
| polymer (60 wt.-% of paraffin inhibitor component) | 25.3 wt.-% |
| Anionic surfactant | 1.7 wt.-% |
| Water | 32.9 wt.-% |
| Propanediol | 22,8 wt.-% |
| KOH | 0.4 wt.-% |

The amount of anionic surfactant relating to the paraffin inhibitor (comprising polymer and organic solvent (see above)) was 4 wt.-%. The proportion of water/propanediol (wt./wt.) was 59:41.

EXAMPLE 4

Aqueous Dispersion of a Hyperbranched Polyester Modified with Terminal Behenyl Acid Groups (Paraffin Inhibitor Type (X6)) in Solvesso® 150 ND (Polymer/Solvent 50/50 wt/wt) Stabilized by 4 wt.-% of Anionic Surfactant (23 wt.-% Polymer in the Dispersion).

Synthesis of the Paraffin Inhibitor Component $1^{st}$ Step

In the first step, a hyperbranched polyester is produced. The reactor is purged with nitrogen. dimethylolproionic acid (DMPA, 375.48 g, 2.80 mol) and trimethylolpropane (TMP, 1.88 g, 0.014 mol), both in solid form, are first introduced to the reactor. 74.72 g (0.01868 mol) of polypropyleneglycol having an average molecular weight $M_n$ of ~4000 g/mol and 1.44 g of methane sulfonic acid are premixed in a separate vessel and added to the reactor. Thereafter, the reactor is heated to 160° C. while stirring. Once the temperature reaches 130° C., the pressure is reduced to 250 to 500 mbar. The reaction is controlled via the acid-number value. The reactor is kept at 160° C. until the acid number was 22 mg KOH/g.

$2^{nd}$ Step

In the $2^{nd}$ step, terminal OH-groups of the hyperbranched polyester are esterified with behenyl acid (technical mixture comprising as main components 85 to 90 wt. % of behenyl acid (linear $C_{22}$ carboxylic acid), ~10 wt. % of $C_{20}$ carboxylic acid, and ~5 wt. % $C_{18}$ caboxylic acid). The temperature in the reactor is kept at 160° C. and 807.36 g (2.40 mol) of behenyl acid are added portionwise in solid form. The reaction is controlled via the acid-number value. After about 6 h, and acid number of 15 mg KOH/g is reached and the reaction is finished. Finally, the polymer at 160° C. is poured into the same amount of Solvesso® 150 ND while stirring to achieve a paraffin inhibitor component, comprising 50% by weight of a paraffin inhibitor X5 and 50% by weight of Solvesso® 150 ND having a melting point of 37° C. $M_w$ of the final polymer: ~16000 g/mol.

Preparation of an Aqueous Dispersion

For the preparation of a stable oil/water emulsion 90.0 g of melted paraffin inhibitor component prepared as described above was placed into a pre-heated reactor at 65° C. While stirring, 11.25 g of an aqueous solution of the anionic surfactant 1 (31 wt.-%) was added slowly, followed by 48.1 g of water and 43.8 g of 1,2-propanediol.

After stirring for 15 min at 60° C., the warm pre-emulsion was poured into a beaker of 250 ml, a stirring rod was added and kept at 60° C., in order to be treated with ultrasound using a Hielscher ultrasound generator UP400S (400 Watt, 24 kHz) with a Sonotrode H14 with a max. amplitude of 125 μm. The tip of the ultrasound probe was immersed for 2 cm deep into the liquid and the magnetic stirrer engine was started ensuring a efficient homogenization. The pre-emulsion was treated at 50% power for 10 minutes and this resulted into a stable emulsion which was cooled to RT under stirring over one hour. Afterwards it was filtered via a 125 μm filter into a container. No coagulum was found. The final dispersion was obtained as a white opaque, viscous liquid.

The resulting particle size of the dispersion $D_{50}$ was monomodal at 154 nm.

The obtained dispersion comprises (the numbers relate to the total of all components of the aqueous dispersion):

| | |
|---|---|
| Paraffin inhibitor component (polymer + org. solvent) | 46.6 wt.-% |
| polymer (50 wt.-% of paraffin inhibitor component) | 23.3 wt.-% |
| Anionic surfactant | 1.8 wt.-% |
| Water | 28.9 wt.-% |
| ethylene glycole | 22.7 wt.-% |

EXAMPLE 5

Aqueous Dispersion of an Grafted EVA Polymer (Paraffin Inhibitor Type (X3) in Solvesso® 150 ND and Shellsol® D70 (Polymer/Solvent1/Solvent 2=50/25/25 wt/wt/Wt) Stabilized by 4 wt.-% of Anionic Surfactant (23 wt.-% of Polymer in Dispersion)

Synthesis of the Paraffin Inhibitor Component

A ethylene-vinylacetate copolymer (Escorene® Ultra UL 02133EN2) (60.45 g) was dissolved in a high-boiling aliphatic hydrocarbon solvent (Shellsol® D70) (144.3) and stearyl acrylate (246.48 g) with heating at 95° C. for about 30 to 60 min. After full dissolution of the ethylene-vinylacetate copolymer, the solution was cooled to 75° C. and tert-dodecylmercaptan (1.3656 g) was added to generate a ca. 70 wt % solution. After $O_2$ removal via bubbling the monomer solution with $N_2$ (30 min) a 9 wt. % solution of t-butylhydroperoxide in an organic solvent (7.633 g) was fed into the reaction solution with step-wise within 5 h. After adding the initiator, the reactor is heated to 90° C. and an additional amount of the 9 wt. % solution of t-butylhydroperoxide in an organic solvent (3.816 g) was fed into the reaction vessel over 1 h and left to stir for a further 1.5 h at 90° C. After the post-polymerisation period, a high-boiling aromatic hydrocarbon (Solvesso® 150 ND) (154.66 g) and MEHQ (0.062 g, 100 ppm) were added to the reaction vessel, stirred for 30 min at 90° C. and the final product was cooled to room temperature under constant stirring. The final product comprises about 50 wt. % of the paraffin inhibitor (an EVA with polystearylarylate which is at least partly grafted the EVA) in Shellsol D70 (about 25 wt %) and Solvesso 150 ND (about 25 wt %).

Preparation of an Aqueous Dispersion

For the preparation of a stable oil/water emulsion 90.0 g of melted paraffin inhibitor component as described above was placed into a pre-heated reactor at 60° C. While stirring, 11.25 g of an aqueous solution of the anionic surfactant 1 (31 wt.-%) was added slowly, followed by 48.1 g of water and 43.8 g of 1,2-propanediol.

After stirring for 15 min at 55° C., the warm pre-emulsion was poured into a beaker of 250 ml, a stirring rod was added and kept at 55° C., in order to be treated with ultrasound using a Hielscher ultrasound generator UP400S (400 Watt, 24 kHz) with a Sonotrode H14 with a max. amplitude of 125 μm. The tip of the ultrasound probe was immersed for 2 cm deep into the liquid and the magnetic stirrer engine was started ensuring a efficient homogenization. The pre-emulsion was treated at 50% power for 10 minutes and this resulted into a stable emulsion, which was cooled to RT under stirring over one hour and afterwards was filtered via a 125 μm filter into a container. No coagulum was found. The final dispersion was obtained as a white opaque, slightly viscous liquid.

The resulting particle size of the dispersion $D_{50}$ was monomodal at 331 nm.

The obtained dispersion comprises (the numbers relate to the total of all components of the aqueous dispersion):

| | |
|---|---|
| Paraffin inhibitor component (polymer + org. solvent) | 46.6 wt.-% |
| polymer (50 wt.-% of paraffin inhibitor component) | 23.3 wt.-% |
| Anionic surfactant | 1.8 wt.-% |
| Water | 28.9 wt.-% |
| Propanediol | 22.7 wt.-% |

EXAMPLE 6

Aqueous Dispersion of a Copolymer of Ethylene and Ethylene Acetate EVA-2 (Paraffin Inhibitor Type X3) in Solvesso® 150 ND (Polymer/Solvent 70/30 wt/wt) Stabilized by 4 wt.-% of Anionic Surfactant (30 wt.-% of Polymer in Dispersion)

(The Percentages Relate to the Total of all Components)

Synthesis of the Paraffin Inhibitor Component

An Ethylene-Vinyl Acetate copolymer with a vinyl acetate content of 30 wt. % and a melt viscosity @ 120° C.=ca. 70 mPas was prepared according to the examples in page 7 of WO 99/29748 A1.

Preparation of an Aqueous Dispersion

For the preparation of a stable oil/water emulsion 40 g of melted paraffin inhibitor component EVA-2 (X3) was placed into a pre-heated reactor at 65° C. and mixed with 17.10 g of Solvesso 150 ND. While stirring, 7.5 g of an aqueous solution of the anionic surfactant 1 (31 wt.-%) was added slowly, followed by 35.5 g of water and 33.0 g of ethylene glycol. This pre-emulsion was stirred for another 15 min at 60° C.

The pre-emulsion was poured into a beaker of 250 ml, a stirring rod was added and kept at 60° C., in order to be treated with ultrasound using a Hielscher ultrasound generator UP400S (400 Watt, 24 kHz) with a Sonotrode H14 with a max. amplitude of 125 μm. The tip of the ultrasound probe was immersed for 2 cm deep into the liquid and the magnetic stirrer engine was started ensuring a efficient homogenization. The pre-emulsion was treated at 50% power for 10 minutes and this resulted into a stable emulsion which was cooled to RT under stirring over one hour. Afterwards it was filtered via a 125 μm filter into a container. No coagulum was found. The final dispersion was obtained as a white opaque, viscous liquid.

The resulting particle size of the dispersion $D_{50}$ was monomodal at 335 nm and had a solid content of 38.2%.

The obtained dispersion comprises (the numbers relate to the total of all components of the aqueous dispersion):

| | |
|---|---|
| Paraffin inhibitor component (polymer + org. solvent) | 42.8 wt.-% |
| polymer (70 wt.-% of paraffin inhibitor component) | 30 wt.-% |
| Anionic surfactant | 1.75 wt.-% |
| Water | 30.6 wt.-% |
| Ethyleneglycol | 24.85 wt.-% |

The amount of anionic surfactant relating to the paraffin inhibitor component (comprising polymer and organic solvent (see above)) was 4.1 wt.-%. The proportion of water/ethanediol (wt./wt.) was 55:45.

COMPARATIVE EXAMPLE C1

Aqueous Dispersion of an Esterified Copolymer of Maleic Acid Anhydride and $C_{20/24}$ Olefines (Paraffin Inhibitor Type (X1) in Solvesso® 150 ND (Polymer/Solvent 75/25 wt/wt) Stabilized by a 4 wt. % of Non-Ionic Emulsifiers (25 wt. % Polymer)

Comparative Example C1 was carried out as example 1, except that the anionic surfactant 1 was substituted by a mix of the three non-ionic surfactants, non-ionic surfactant 1 (1.67 wt.-%), non-ionic surfactant 2 (1.67 wt.-%), and non-ionic surfactant 3 (0.67 wt.-%). A mixture of three non-ionic surfactants as suggested by WO 2018/104071 A1 was used. The final dispersion was obtained as a white opaque, slightly viscous liquid.

The resulting particle size of the dispersion $D_{50}$ was monomodal 632 nm.

EXAMPLE C2

Aqueous Dispersion of an Esterified Copolymer of Maleic Acid Anhydride and $C_{20/24}$ Olefines (Paraffin Inhibitor Type (X1) in Solvesso® 150 ND (Polymer/Solvent 75/25 wt/wt) Stabilized by 7.5 wt. % of Non-Ionic Emulsifiers (25 wt. % Polymer)

Comparative Example C2 was carried out as example 1, except that the amount of anionic surfactant 1 was increased to 7.5 wt.-%.

The final dispersion was obtained as a white opaque, slightly viscous liquid.

The resulting particle size of the dispersion $D_{50}$ was monomodal 265 nm.

Method B

Dispersion of Starting Materials in an Aqueous Phase Followed by Polymerization

EXAMPLE 7

Aqueous Dispersion of a Graft Polymer of an Ethylene-Vinylacetate Copolymer and Stearylacrylate (Paraffin Inhibitor (X3)) in Shellsol® D70 (Polymer/Solvent 64/36 wt/wt) Stabilized by 6.5 wt.-% of Anionic Surfactant 1 (Polymer 27 wt.-%)

In a reactor, 15.0 g of the ethylene-vinyl acetate copolymer EVA-1 and 60.0 g of stearylacrylate were dissolved in 41.5 g of Shellsol® D70 at 95° C. for one hour under a lean air atmosphere (5% $O_2$) to obtain a clear solution.

For the preparation of a stable oil/water emulsion, the abovementioned solution was cooled down to 75° C. and 0.57 g of tert-dodecylmercaptane and a pre-warmed (50° C.) solution of 24.6 g of an aqueous solution of the anionic surfactant 1 (39 wt. %); 51.6 g of 1,2-propanediol and 48.1 g of water were added. The resulting pre-emulsion was treated in an Ultrasound equipment at 50% power as described in example 3 for 10 minutes while stirring, maintaining the temperature above 70° C. all the time. This resulted in a stable emulsion with a D50 droplet size of 272 nm.

The emulsion was transferred to a reactor equipped with an overhead stirrer, nitrogen inlet, thermometer, heating mantle, and syringe pump. The emulsion was brought to 60° C. and inerted under a nitrogen atmosphere. 22.2 g of tert-butyl hydroperoxide (10% solution in water) was added to the reactor. Subsequently, 12.0 g of a reducing agent on basis of sulfinic acid (Brüggolit® FF6M) (30% solution in water) was added via a syringe pump over a period of 2.5 hours to the reaction mixture at 60° C.

After the addition, the reaction mixture was continuously stirred by a mechanical stirrer and was maintained at 60° C. for one hour, then cooled to RT and filtered via a 125 μm filter. No coagulum was found. The final dispersion was obtained as a white opaque, slightly viscous liquid.

The resulting particle size of the dispersion $D_{50}$ was monomodal 215 nm, and the $M_w$ was 9040 g/mol (polydispersity $M_w/M_n$ 4.6). The melting point of the paraffin inhibitor component is ~8° C.

| | |
|---|---|
| Paraffin inhibitor component (polymer + org. solvent) | 42.3 wt.-% |
| polymer (64.3 wt.-% of paraffin inhibitor component) | 27.2 wt.-% |
| Anionic surfactant | 2.8 wt.-% |
| Water | 33.2 wt.-% |
| Propanediol | 18.7 wt.-% |
| Initiator system | 3.0 wt.-% |

The amount of anionic surfactant relating to the PPD2 (comprising polymer and organic solvent (see above)) was 6.5 wt.-%. The proportion of water/propanediol (wt./wt.) was 59:41.

Application Tests

Stability of the Aqueous Dispersions

The stability of the dispersions was tested at three different temperatures: −20° C., room temperature (21 to 23° C.) and 50° C.

For determining the stability 20 ml of each dispersion were stored in glass bottles at the three different temperatures for at least 4 weeks. After said storage, the dispersions were visually inspected. It was checked whether they showed a separation or creaming/sedimentation. To quantify the stability of the dispersion the following criteria were developed:

| | |
|---|---|
| 1 | Dispersion is stable and homogeneous. No creaming/sedimentation or separation can be observed. Dispersion is also fluid. No solidification or gelling. |
| 2 | Dispersion is stable with slight streaking formation. No creaming/sedimentation or separation can be observed. Dispersion is also fluid, but maybe more viscous. No solidification or gelling |
| 3 | Dispersion shows a separation. Creaming or sedimentation might be observed. Some dispersions do not flow any more. Some solid particles might be visible. |
| 4 | Dispersion solidified as a whole |
| 5 | Dispersion coagulated irreversibly |

The results are summarized in the following table 1:

TABLE 1

Results of the stability tests

| Example | Storage/ weeks | Stability −20° C. | Stability RT | Stability 50° C. |
|---|---|---|---|---|
| C1 | 4 w | 1 | 3 | 3 |
| C2 | 4 w | 1 | 3 | 1 |

TABLE 1-continued

Results of the stability tests

| Example | Storage/ weeks | Stability −20° C. | Stability RT | Stability 50° C. |
|---|---|---|---|---|
| 1 | 4 w | 1 | 1 | 1 |
| 2 | 4 w | 1 | 1 | 1 |
| 3 | 4 w | 1 | 1 | 1 |
| 7 | 4 w | 1 | 1 | 1 |

Comments:

Whereas example 1-3 and 7 show no changes at any of the temperatures for at least 4 weeks, comparative examples C1 an C2 showed phase separation at at least one temperature. Phase separation can lead to blocking of lines and doesn't allow for homogeneous dosing, even when the product is still pumpable. Since, the active ingredient is in the oil phase, dosing the aqueous phase will result in no effect in respect to pour point reduction or reduction in paraffin crystallization, whereas dosing of the oil phase will lead to higher than required addition of additive, which in some cases might even be detrimental as well.

Pour Point Testing

The pour point and no flow point was determined with a Pour Point-Tester 45150 from PSL (Osterode am Harz, Germany). The pour point is measured according to ASTM D5985.

A 2 liter aluminum bottle containing the crude oil was heated to 80° C. for 30 minutes. During the heating process the bottle was shaken repeatedly to homogenize the crude oil. Then 50 ml of the crude oil were transferred to a 100 ml plastic bottle. The bottle was heated to 80° C. again for 15 minutes. After that, the dispersion containing 500 ppm of active PPD was added to the crude oil. Then the crude oil with the dispersion was shaken. Finally, the sample was heated to 80° C. again for 15 min. Approximately 30 ml of the sample were then transferred to the cup of the pour point tester so that it was filled up to the calibration line. The cup was inserted into the pour point tester, the sensor head was put into the sample and the measuring was started. The sample was firstly heated until 70° C. before the pour point measurement was started.

Several test were carried out varying the crude oils, whose origine and characteristics are describe in Table 2, the paraffin inhibitor (pour point depressant; PPD) type and the solution type used for the paraffin inhibitor. The results are summarized in Table 3.

TABLE 2

Description of the crude oils used for the application tests

| Crude oil type | API gravity | Pour Point (° C.) | WAT (° C.) by DSC |
|---|---|---|---|
| 1 | 32.21 | 21 | 45.47 |
| 2 | 36.75 | 24 | 50.97 |
| 3 | 36.8 | 24 | 51.55 |
| 4 | 44 | <−30 | 33.5 |
| 5 | 36.56 | −30 | 24.87 |
| 6 | 25.38 | 27 | 43.43 |
| 7 | 45.93 | −24 | 25.41 |
| 8 | 37.31 | 9 | 35.46 |
| 9 | 35.24 | 12 | 21.18 |

TABLE 3

Results of Pour point testing

| Table entry | Crude oil type | Paraffin inhibitor (PPD) type*** | Dosage, active PPD (ppm) | Anionic surfactant | Active amount of active surfactant (wt. %*) | Solution type of the PPD | $D_{50}$ particle size (nm) | Pour Point (° C.) | Non-Flow Point (° C.) |
|---|---|---|---|---|---|---|---|---|---|
| 1 | 1 | — | — | — | — | — | — | 21 | 18 |
| 2 | 1 | X1 | 500 | — | | Organic solvent-based solution | — | 15 | 13.6 |
| 3 | 1 | X1[a] | 500 | Anionic surfactant 1 | 4 | Aqueous dispersion | 205 | 18 | 15.7 |
| 4 | 2 | — | — | — | — | — | — | 24 | 23 |
| 5 | 2 | X3 | 500 | — | | Organic solvent-based solution | — | 18 | 15.8 |
| 7 | 2 | X3[b] | 500 | Anionic surfactant 1 | 6.51 | Aqueous dispersion | 312 | 18 | 16.1 |
| 9 | 2 | X3[b] | 500 | Anionic surfactant 1 | 6.51 | Aqueous dispersion | 309 | 18 | 15.3 |
| 10 | 2 | X3 | 500 | — | — | Organic solvent-based solution | — | 9 | 8.4 |
| 11 | 2 | X3[a] | 500 | Anionic surfactant 1 | 4 | Aqueous dispersion | n.m.** | 15 | 12.1 |
| 12 | 3 | — | — | — | — | — | — | 24 | 22.7 |
| 13 | 3 | X6 | 500 | — | — | Organic solvent-based solution | — | 15 | 13.6 |
| 14 | 3 | X6[a] | 500 | Anionic surfactant 1 | 4 | Aqueous dispersion | 181 | 15 | 14.2 |
| 15 | 3 | X2[b] | 500 | Anionic surfactant 1 | 6.51 | Aqueous dispersion | 169 | 18 | 16.9 |

*Relating to the amount of paraffin inhibitor component (paraffin inhibitor + optionally a hydrocarbon or a hydrocarbon mixture having a boiling point of at least 100° C.)

**n.m. = not measured

***PPDs described under the same X-category were manufactured, for the purpose of testing, using the same monomers and ratio. This applies across Tables 3-5 and 8.

Cold Finger (Wax Inhibition) Testing

The cold finger deposition test is used to determine the wax inhibition properties of the dispersions. The wax inhibition was determined by exposing the crude oil to a cold metal finger surface in the presence and absence of the inhibitor. The amount and type of wax deposited on the cold metal finger was used to determine waxing tendency.

The test was started by conditioning the oil sample by heating to 80° C. and holding for 30 minutes to remove thermal history. A water bath on the cold finger apparatus was adjusted so that the oil temperature was maintained at 30° C. The cold finger was maintained at 15° C. and the cold finger was inserted into the oil sample. The test was run for 6 hours. The cold finger was removed, and the wax deposit on it was collected with a paper towel. The wax deposit was weighed. The wax test was repeated in the presence and absence of the inventive dispersion. The percent efficacy was calculated on the performance of paraffin inhibitor as compared to the baseline (i.e. the measurement without wax inhibitor).

Several test were carried out varying the crude oils used and varying the amount of Pour point depressant (PPD). The results are summarized in the following table:

TABLE 4

Results of wax inhibition testing

| Table entry | Crude oil type | Paraffin inhibitor (PPD) type*** | Dosage, active PPD (ppm) | Anionic surfactant | Amount of active surfactant (wt. %*) | Solution type of the PPD | $D_{50}$ particle size (nm) | % wax inhibition |
|---|---|---|---|---|---|---|---|---|
| 1 | 2 | X1 | 500 | — | — | | — | 46.36 |
| 2 | 2 | X1[a] | 500 | Anionic surfactant 1 | 4 | | 205 | 50.77 |
| 3 | 4 | X1 | 100 | — | — | Organic solvent-based solution | — | 67 |
| 4 | 4 | X1[a] | 100 | Anionic surfactant 1 | 4 | Aqueous dispersion | 205 | 45 |
| 5 | 5 | X1 | 150 | — | — | Organic solvent-based solution | — | 85 |
| 6 | 5 | X1[a] | 150 | Anionic surfactant 1 | 4 | Aqueous dispersion | 205 | 85 |
| 7 | 4 | X2[b] | 100 | Anionic surfactant 1 | 6.51 | Aqueous dispersion | 169 | 34 |
| 8 | 6 | X2[b] | 120 | Anionic surfactant 1 | 6.51 | Aqueous dispersion | 169 | 67 |
| 9 | 7 | X2[b] | 25 | Anionic surfactant 1 | 6.51 | Aqueous dispersion | 169 | 86 |
| 10 | 8 | X2[b] | 25 | Anionic surfactant 1 | 6.51 | Aqueous dispersion | 169 | 51 |
| 11 | 8 | X2[b] | 100 | Anionic surfactant 1 | 6.51 | Aqueous dispersion | 169 | 94 |
| 12 | 5 | X2[b] | 25 | Anionic surfactant 1 | 6.51 | Aqueous dispersion | 169 | 35 |
| 13 | 5 | X2[b] | 50 | Anionic surfactant 1 | 6.51 | Aqueous dispersion | 169 | 28 |
| 14 | 5 | X2[b] | 100 | Anionic surfactant 1 | 6.51 | Aqueous dispersion | 169 | 55 |
| 15 | 2 | X3 | 500 | Anionic surfactant 1 | — | Organic solvent-based solution | — | 1.74 |
| 16 | 2 | X3[a] | 500 | Anionic surfactant 1 | 4 | Aqueous dispersion | n.m.** | 8.05 |

*Relating to the amount of paraffin inhibitor component (paraffin inhibitor + optionally a hydrocarbon or a hydrocarbon mixture having a boiling point of at least 100° C.)

**n.m. = not measured

***PPDs described under the same X-category were manufactured, for the purpose of testing, using the same monomers and ratio. This applies across Tables 3-5 and 8.

[a]Prepared by method A;

[b]Prepared by method B

Yield Stress Testing

Stress-ramp tests were conducted to determine the amount of stress that must be applied to the sample before it begins to flow.

The test was started by conditioning the sample by homogenizing the crude oil at 10° C. above the WAT or 80° C., followed by heating the homogenized sample at 45° C. at a shear rate of 10 $s^{-1}$ for 10 minutes. Afterwards, the sample was cooled down. The sample was cooled from 45° C. to −5° C. at a rate of 1° C./min without shearing, followed by maintaining the sample at −5° C. for 16 h without shearing.

The prepared sample was tested at given temperature by applying a gradually increasing shear stress. The shear stress was increased from 1 to 850 Pa.

Tests were carried out to compare the yield points of a crude oil (entry 1, Table 5), of that crude oil mixed with an organic solvent-based solution of a paraffin inhibitor type X6 (entry 2, Table 5), and of that crude oil mixed with an aqueous dispersion of a paraffin inhibitor type X6 (entry 3, Table 5). The results are summarize in the following table:

TABLE 5

Results of yield stress testing

| Table entry | Crude oil type | Paraffin inhibitor (PPD) type** | Dosage, active PPD (ppm) | Anionic surfactant | Amount of active surfactant (wt. %*) | Solution type of the PPD | $D_{50}$ particle size (nm) | Yield stress/ yield point (Pa) |
|---|---|---|---|---|---|---|---|---|
| 1 | 2 | — | — | — | — | — | — | >100 |
| 2 | 2 | X6 | 500 | — | — | Organic solvent-based solution | 1 | 17 |
| 3 | 2 | X6[a] | 500 | Anionic surfactant 1 | 4 | Aqueous dispersion | 181 | 22 |

*Relating to the amount of paraffin inhibitor component (paraffin inhibitor + optionally a hydrocarbon or a hydrocarbon mixture having a boiling point of at least 100° C.)
**PPDs described under the same X-category were manufactured, for the purpose of testing, using the same monomers and ratio. This applies across Tables 3-5 and 8.
[a]Prepared by method A.

Cold Filter Plugging Point Testing

The cold filter plugging point (CFPP) is the lowest temperature at which a given volume of mineral oil still passes through a standardized filtration device in a specified time when cooled under certain conditions. This test gives an estimate for the lowest temperature that a oil will give trouble free flow in certain tubing systems. This is important as in cold temperate countries, a high cold filter plugging point will clog up tubes more easily.

The CFPP was measures according to the to the European Standard DIN EN 116. Two aqueous dispersions containing a different type of paraffin inhibitor were testes in two different mineral oils. The characteristics of the mineral oils used are summarized in Tables 6 and 7 and were measured according to the European Standard DIN EN 590. The CFPP results are summarized in Table 8.

TABLE 6

Characteristics of mineral oils used for the CFPP testing

| Mineral oil | CP (° C.) | CFPP (° C.) | Viscosity ($mm^2/s$ @ 15° C.) | Density @15° C. (kg/m3) | conductivity (pS/m) | Pour Point (° C.) | no Flow (° C.) |
|---|---|---|---|---|---|---|---|
| 1 | −9.4 | −10 | 3.7795 | 833 | n.m.** | −21 | −22.2 |
| 2 | −9.5 | −11 | 3.77 | 826.3 | 320 | −18 | −18.2 |

**n.m. = not measured

TABLE 7

Boiling analysis of mineral oils used for the CFPP testing. All values are given in ° C.

| Mineral oil | IBP | 5% | 10% | 15% | 20% | 25% | 30% | 35% | 40% | 45% | 50% | 55% | 60% | 65% | 70% | 75% |
|---|---|---|---|---|---|---|---|---|---|---|---|---|---|---|---|---|
| 1 | 172 | 188 | 195 | 201 | 207 | 213 | 219 | 226 | 233 | 240 | 247 | 254 | 262 | 270 | 279 | 289 |
| 2 | 167 | 183 | 190 | 195 | 202 | 208 | 215 | 222 | 230 | 238 | 247 | 256 | 265 | 275 | 285 | 296 |

TABLE 8

Results of CFPP testing

| Table entry | Mineral oil | Paraffin inhibitor (PPD)*** | Dosage, active PPD (ppm) | Anionic surfactant | Amount of active surfactant (wt. %*) | $D_{50}$ particle size (nm) | CFPP (° C.) |
|---|---|---|---|---|---|---|---|
| 1 | 1 | X4 | 150 | Anionic surfactant 1 | 4 | 274 | −20 |
| 2 | 1 | X5 | 90 | Anionic surfactant 1 | 4 | n.m.** | −14 |
| 3 | 2 | X4 | 150 | Anionic surfactant 1 | 4 | 274 | −25 |
| 4 | 2 | X5 | 180 | Anionic surfactant 1 | 4 | n.m.** | −22 |

*Relating to the amount of paraffin inhibitor component (paraffin inhibitor + optionally a hydrocarbon or a hydrocarbon mixture having a boiling point of at least 100° C.)
**n.m. = not measured
***PPDs described under the same X-category were manufactured, for the purpose of testing, using the same monomers and ratio. This applies across Tables 3-5 and 8.

The invention claimed is:

1. An aqueous dispersion comprising at least (A) a continuous aqueous phase comprising water and a water-miscible organic solvent, (B) a dispersed phase comprising at least one paraffin inhibitor component having a melting point of not more than 100° C., wherein the amount of the paraffin inhibitor component is from 10% to 60% by weight relating to the total of all components of the aqueous dispersion, and the paraffin inhibitor component comprises at least 30% to 100% by weight-relating to the total of the paraffin inhibitor component-of at least one polymeric, oil-soluble paraffin inhibitor (X), 0% to 70% by weight-relating to the total of the paraffin inhibitor component-of a hydrocarbon or a hydrocarbon mixture having a boiling point of at least 100° C., and (C) at least one surfactant (S), wherein the surfactant (S) is anionic and comprises at least one anionic group selected from sulfonate, sulfate, phosphonate or phosphate groups, the amount of the surfactants (S) is from 1% to 7% by weight relating to the paraffin inhibitor component, and the $D_{50}$ particle size (volume size distribution) of the dispersed phase, measured by dynamic light scattering is from 50 nm to 500 nm, wherein the polymeric, oil-soluble paraffin inhibitor (X) is paraffin inhibitor (X1), wherein paraffin inhibitor (X1) comprises, as monomers, a-olefins having 10 to 60 carbon atoms, and monoethylenically unsaturated monomers comprising carboxylate groups, where some or all of the carboxylate groups have been reacted with aliphatic, cycloaliphatic or aromatic alcohols and/or primary amines, with the proviso that at least 50 mol % of the alcohols or primary amines are linear aliphatic alcohols or linear aliphatic amines having 16 to 32 carbon atoms;

wherein the aqueous dispersion is stable and fluid when stored at −20° C. for a storage period of at least four weeks.

2. The aqueous dispersion according to claim 1, wherein the melting point of the paraffin inhibitor component is from 30° C. to 95° C.

3. The aqueous dispersion according to claim 1, wherein the paraffin inhibitor component comprises 60% to 90% by weight of the polymeric, oil-soluble paraffin inhibitor(s) (X), and 10% to 40% by weight of the hydrocarbon or a hydrocarbon mixture.

4. The aqueous dispersion according to claim 1, wherein the water-miscible organic solvent is at least one selected from the group of ethylene glycol, diethylene glycol, 1,2-propylene glycol, 1,3-propylene glycol, ethylene glycol monomethyl ether and propylene glycol monomethyl ether, dipropylene glycol monomethyl ether and glycol monobutyl ether.

5. The aqueous dispersion according to claim 1, wherein the amount of water in the aqueous phase (A) is from 20% to 40% by weight, and the amount of water-soluble organic solvents is from 60% to 80% by weight, in each case based on the amount of all components of the aqueous phase, and wherein the amount of the paraffin inhibitor component is from 20% to 35% by weight, relating to the total of all components of the aqueous dispersion.

6. The aqueous dispersion according to claim 1, wherein the anionic surfactants comprise at least an alkyl ether sulfate having the general formula (I)

$$R^7—O—(CH_2CHR^8—O)_n—SO_3^-M^+ \quad (I)$$

wherein $R^7$ is linear, branched or cyclic alkyl group having 6 to 36 carbon atoms, $R^8$ is a group selected from H, methyl or ethyl, with the provisio, that at least 50 mol % of the groups $R^7$ are H, M is $H^+$ or a monovalent counterion, and n is a number from 0 to 60.

7. The aqueous dispersion according to claim 6, wherein $R^7$ has 8 to 20 carbon atoms, and n is a number from 2 to 20.

8. The aqueous dispersion according to claim 1, wherein the polymeric, oil-soluble paraffin inhibitor (X1) comprises, as monomers, 40% to 60 mol % of a-olefins having 10 to 32 carbon atoms, and 60% to 40 mol % of maleic acid, where at least a part of the carboxylate groups have been reacted with aliphatic, cycloaliphatic and/or aromatic alcohols and/or primary amines, with the proviso that at least 50 mol % of the alcohols are or primary amines are linear aliphatic alcohols or linear primary amines having 16 to 32 carbon atoms, and where the degree of esterification or amidation is 30% to 60%, based on the number of all carboxylate groups present.

9. A process for producing an aqueous dispersion according to claim 1, which comprises (a1) Providing an oil-in-water emulsion by mixing the paraffin inhibitor component at a temperature above its melting point with at least water and the surfactant(s) (S) and distributing it in the aqueous phase, (a2) homogenizing the oil-in-water emulsion by means selected from the group of a homogenizer, ultrasound treatment, or a rotor-stator disperser, and (a3) adding a water-miscible organic solvent, wherein the addition may be carried out at any stage of the process.

10. A process for producing an aqueous dispersion according to claim 1, which comprises (b1) providing an oil-in-water emulsion by mixing the monomers for forming the polymeric, oil-soluble paraffin inhibitor (X1) with the surfactant(s) (S) and at least a portion of the aqueous phase, and (b2) homogenizing the oil-in-water emulsion by means of a homogenizer, ultrasound treatment, or a rotor-stator disperser, and (b3) adding initiators for radical polymerization to the homogenized oil-in-water emulsion and polymerizing, thereby obtaining a paraffin inhibitor component which is a dispersed phase in a continuous aqueous phase.

11. A fuel or fuel oil comprising at least one aqueous dispersion according to claim 1, wherein the aqueous dispersion is used in such an amount that the concentration of the paraffin inhibitors (X) is from 10 ppm to 3,000 ppm by weight based on the fuel oil.

12. A fuel according to claim 11, wherein the fuel is a diesel fuel (absent any additives) with a Cloud Point value according to ASTM D2500/ASTM D97 of 0 to −15° C. and/or with a content of paraffines of from 10 to 30% by weight.

* * * * *